US010311847B2

(12) United States Patent
Ichiki et al.

(10) Patent No.: US 10,311,847 B2
(45) Date of Patent: Jun. 4, 2019

(54) KEYBOARD APPARATUS

(71) Applicant: YAMAHA CORPORATION, Hamamatsu-shi (JP)

(72) Inventors: Shunsuke Ichiki, Hamamatsu (JP); Hirotsugu Suzuki, Hamamatsu (JP); Ichiro Osuga, Hamamatsu (JP)

(73) Assignee: YAMAHA CORPORATION, Hamamatsu-Shi (JP)

( * ) Notice: Subject to any disclaimer, the term of this patent is extended or adjusted under 35 U.S.C. 154(b) by 0 days.

(21) Appl. No.: 15/924,838

(22) Filed: Mar. 19, 2018

(65) Prior Publication Data

US 2018/0286369 A1 Oct. 4, 2018

(30) Foreign Application Priority Data

Apr. 4, 2017 (JP) ..... 2017-074267

(51) Int. Cl.
*G10C 3/12* (2006.01)
*G10H 1/34* (2006.01)

(52) U.S. Cl.
CPC ..... *G10H 1/346* (2013.01)

(58) Field of Classification Search
CPC ..... G10H 1/346
See application file for complete search history.

(56) References Cited

U.S. PATENT DOCUMENTS 5,243,125 A * 9/1993 Yamaguchi ..... G10H 1/346 84/745
7,485,798 B2 * 2/2009 Nishida ..... G10C 3/12 84/18
7,586,030 B2 * 9/2009 Nishida ..... G10C 3/12 84/423 R
7,692,089 B2 * 4/2010 Nishida ..... G10H 1/32 84/644
8,003,871 B2 * 8/2011 Kitajima ..... G10C 3/12 84/423 R
8,440,896 B2 * 5/2013 Hoshino ..... G10C 3/12 84/423 R
8,993,865 B2 * 3/2015 Liao ..... G10D 13/006 84/422.1
9,502,004 B2 * 11/2016 Ohba ..... G10C 3/22
9,928,815 B2 * 3/2018 Sikra ..... G10D 13/006
2008/0017016 A1 * 1/2008 Toyama ..... G10H 1/344 84/439
2011/0005370 A1 * 1/2011 Kitajima ..... G10H 1/34 84/744

(Continued)

FOREIGN PATENT DOCUMENTS

JP 2008191650 A 8/2008

*Primary Examiner* — Robert W Horn

(74) *Attorney, Agent, or Firm* — Rossi, Kimms & McDowell LLP

(57) ABSTRACT

A keyboard apparatus includes: a key; a frame; and a connecting portion configured to connect the key and the frame to each other. The connecting portion includes a flexible member having a rod shape and having flexibility that enables the key to pivot with respect to the frame. The flexible member includes a portion that, in entirety of a range of pivotal movement of the key, maintains a state in which a length of a line extending along a neutral axis of the flexible member between two points located on the neutral axis is greater than a length of a straight line connecting the two points to each other.

14 Claims, 15 Drawing Sheets

(56) References Cited

U.S. PATENT DOCUMENTS

| | | | | |
|---|---|---|---|---|
| 2018/0286368 | A1* | 10/2018 | Tanoue | G10H 1/344 |
| 2018/0286369 | A1* | 10/2018 | Ichiki | G10H 1/346 |
| 2019/0012992 | A1* | 1/2019 | Ichiki | G10B 3/12 |
| 2019/0027121 | A1* | 1/2019 | Ichiki | G10B 3/12 |
| 2019/0043463 | A1* | 2/2019 | Ichiki | G10H 1/346 |

* cited by examiner

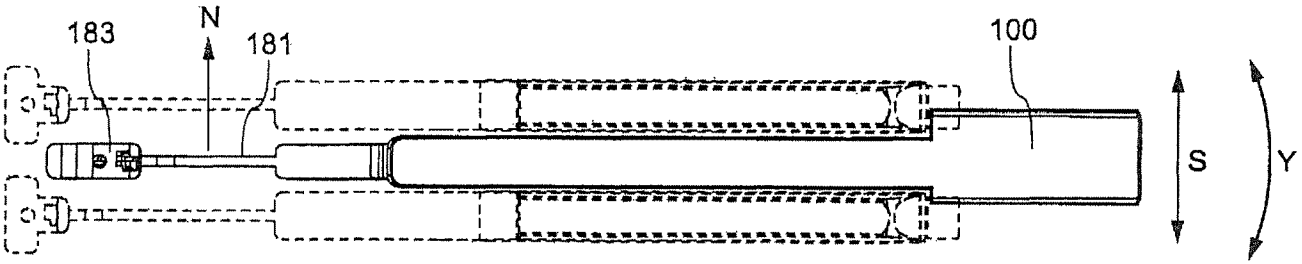
FIG.6A
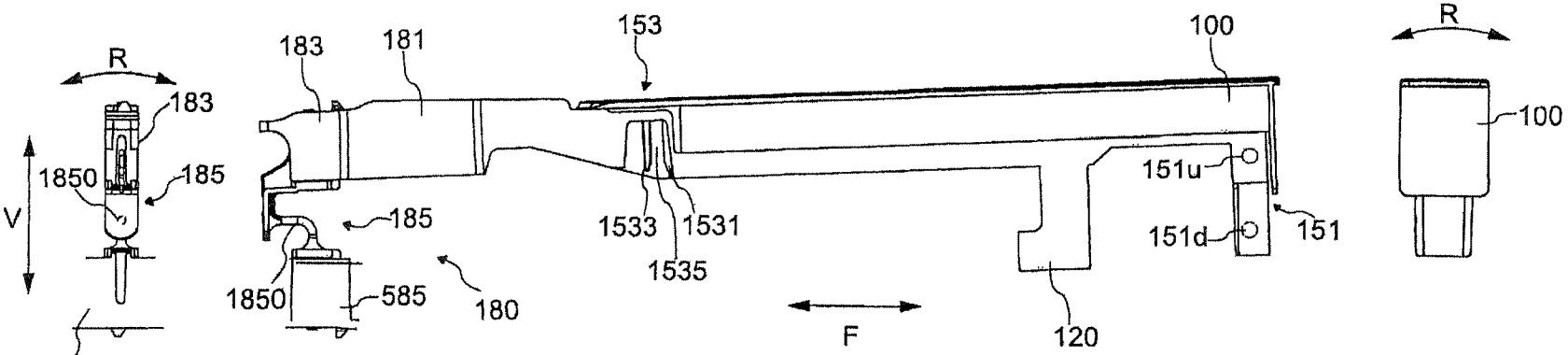
FIG.6D
FIG.6B
FIG.6C

KEYBOARD APPARATUS

CROSS REFERENCE TO RELATED APPLICATION

The present application claims priority from Japanese Patent Application No. 2017-074267, which was filed on Apr. 4, 2017, the disclosure of which is herein incorporated by reference in its entirety.

BACKGROUND

The following disclosure relates to a keyboard apparatus.

Patent Document 1 (Japanese Patent Application Publication No. 2008-191650) discloses a keyboard apparatus in which a flexible thin plate is disposed horizontally as one example of a configuration for pivotal movement of a key. Deformation of the thin plate enables the key to pivot in an up and down direction. Patent Document 1 further discloses a configuration in which a thin plate disposed vertically is connected in series to the thin plate disposed horizontally, to allow movement of the key in a direction in which the keys are arranged.

SUMMARY

Movement of the key with respect to its original position in the direction in which the keys are arranged is caused not only by playing but also by manufacturing error in the key and/or changes in the key with time. Even if this movement has occurred, the flexibility of the thin plate allows movement of the key in the direction in which the keys are arranged in the technique disclosed in Patent Document 1. However, the horizontal thin plate for pivotal movement of the key and the vertical thin plate for allowing movement of the key in the direction in which the keys are arranged have to be connected to each other in series. This requires a region for arrangement of these thin plates. If this region is small, the thin plates need to be small, resulting in a heavy load when the thin plates are bent. If larger thin plates are used in order to reduce this load, the keyboard apparatus needs to be made larger.

Accordingly, an aspect of the disclosure relates to a keyboard apparatus configured to reduce effects on the size of the keyboard apparatus and allow movement or deformation of a key in various directions.

In one aspect of the disclosure, a keyboard apparatus includes: a key; a frame; and a connecting portion configured to connect the key and the frame to each other, the connecting portion including a flexible member having a rod shape and having flexibility that enables the key to pivot with respect to the frame. The flexible member includes a portion that, in entirety of a range of pivotal movement of the key, maintains a state in which a length of a line extending along a neutral axis of the flexible member between two points located on the neutral axis is greater than a length of a straight line connecting the two points to each other.

In another aspect of the disclosure, a keyboard apparatus includes: a key; a frame; and a connecting portion configured to connect the key and the frame to each other, the connecting portion including a flexible member having a rod shape and having flexibility that enables the key to pivot with respect to the frame. The flexible member includes a portion that, in entirety of a range of pivotal movement of the key, maintains a state in which a neutral axis of the flexible member is bent.

In still another aspect of the disclosure, a keyboard apparatus includes: a key; a frame; and a connecting portion configured to connect the key and the frame to each other, the connecting portion including a flexible member having a rod shape and having flexibility that enables the key to pivot with respect to the frame. At least a portion of the flexible member includes: a first straight rod portion extending in a longitudinal direction of the key; a second straight rod portion extending in an up and down direction; and an intermediate rod portion having a rod shape, connecting the first straight rod portion and the second straight rod portion to each other, and extending in a direction different from each of the longitudinal direction and the up and down direction.

BRIEF DESCRIPTION OF THE DRAWINGS

The objects, features, advantages, and technical and industrial significance of the present disclosure will be better understood by reading the following detailed description of the embodiments, when considered in connection with the accompanying drawings, in which:

FIGS. 6A through 6D are views for explaining a configuration of a white key in the first embodiment;

DETAILED DESCRIPTION OF THE EMBODIMENTS

Figure 1:
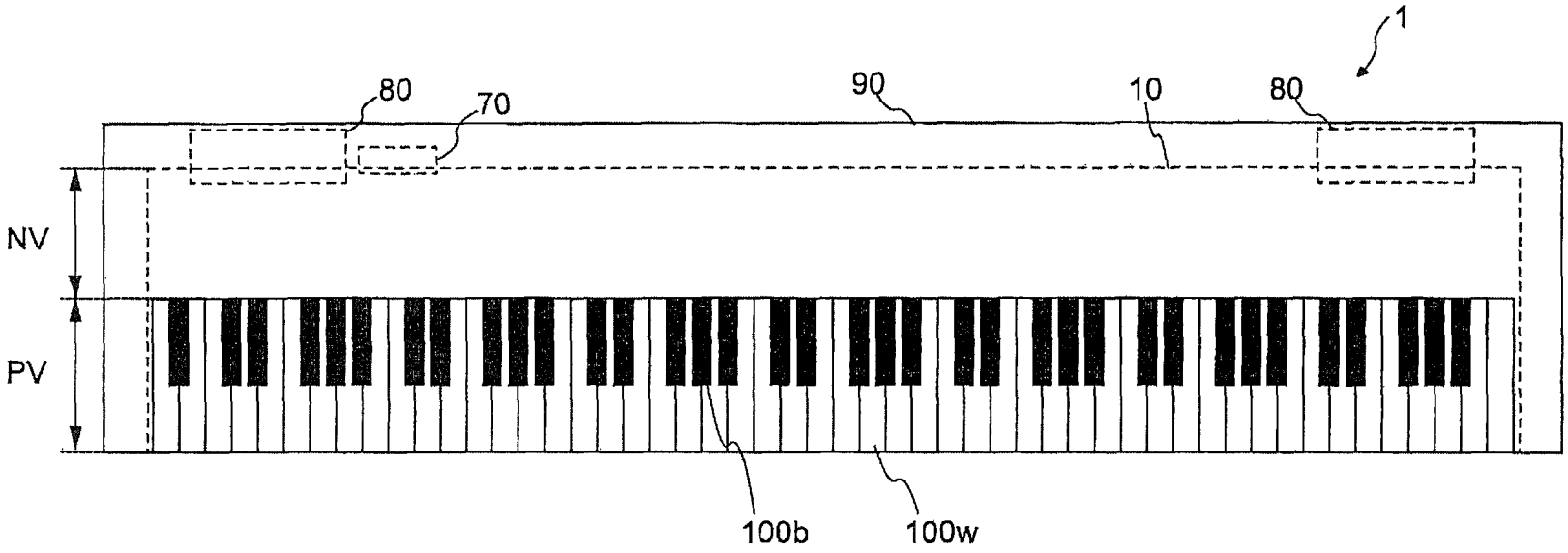
FIG. 1 is a view of a keyboard apparatus according to a first embodiment.

Hereinafter, there will be described embodiments by reference to the drawings. It is to be understood that the following embodiments are described only by way of example, and the disclosure may be otherwise embodied with various modifications without departing from the scope and spirit of the disclosure. It is noted that the same or similar reference numerals (e.g., numbers with a character, such as A or B, appended thereto) may be used for components having the same or similar function in the following description and drawings, and an explanation of which is dispensed with. The ratio of dimensions in the drawings (e.g., the ratio between the components and the ratio in the lengthwise, widthwise, and height directions) may differ from the actual ratio, and portions of components may be omitted from the drawings for easier understanding purposes.

First Embodiment

Configuration of Keyboard Apparatus

FIG. 1 is a view of a keyboard apparatus according to a first embodiment. In the present embodiment, a keyboard apparatus 1 is an electronic keyboard instrument, such as an electronic piano, configured to produce a sound when a key is pressed by a user (a player). It is noted that the keyboard apparatus 1 may be a keyboard-type controller configured to output data (e.g., MIDI) for controlling an external sound source device, in response to key pressing. In this case, the keyboard apparatus 1 may include no sound source device.

The keyboard apparatus 1 includes a keyboard assembly 10. The keyboard assembly 10 includes white keys 100*w* and black keys 100*b* arranged side by side. The number of the keys 100 is N. In the present embodiment, N is 88 but may be a number different from 88. A direction in which the keys 100 are arranged will be referred to as "scale direction". The white key 100*w* and the black key 100*b* may be hereinafter collectively referred to "the key 100" in the case where there is no need of distinction between the white key 100*w* and the black key 100*b*. Also in the following explanation, "w" appended to the reference number indicates a configuration corresponding to the white key. Also, "b" appended to the reference number indicates a configuration corresponding to the black key.

A portion of the keyboard assembly 10 is located in a housing 90. In the case where the keyboard apparatus 1 is viewed from an upper side thereof, a portion of the keyboard assembly 10 which is covered with the housing 90 will be referred to as "non-visible portion NV", and a portion of the keyboard assembly 10 which is exposed from the housing 90 and viewable by the user will be referred to as "visible portion PV". That is, the visible portion PV is a portion of the key 100 which is operable by the user to play the keyboard apparatus 1. A portion of the key 100 which is exposed by the visible portion PV may be hereinafter referred to as "key main body portion".

The housing 90 contains a sound source device 70 and a speaker 80. The sound source device 70 is configured to create a sound waveform signal in response to pressing of the key 100. The speaker 80 is configured to output the sound waveform signal created by the sound source device 70, to an outside space. It is noted that the keyboard apparatus 1 may include: a slider for controlling a sound volume; a switch for changing a tone color; and a display configured to display various kinds of information.

In the following description, up, down, left, right, front, and back (rear) directions (sides) respectively indicate directions (sides) in the case where the keyboard apparatus 1 is viewed from the player during playing. Thus, it is possible to express that the non-visible portion NV is located on a back side of the visible portion PV, for example. Also, directions and sides may be represented with reference to the key 100. For example, a key-front-end side (a key-front side) and a key-back-end side (a key-back side) may be used. In this case, the key-front-end side is a front side of the key 100 when viewed from the player. The key-back-end side is a back side of the key 100 when viewed from the player. According to this definition, it is possible to express that a portion of the black key 100*b* from a front end to a rear end of the key main body portion of the black key 100*b* is located on an upper side of the white key 100*w*.

Figure 2:
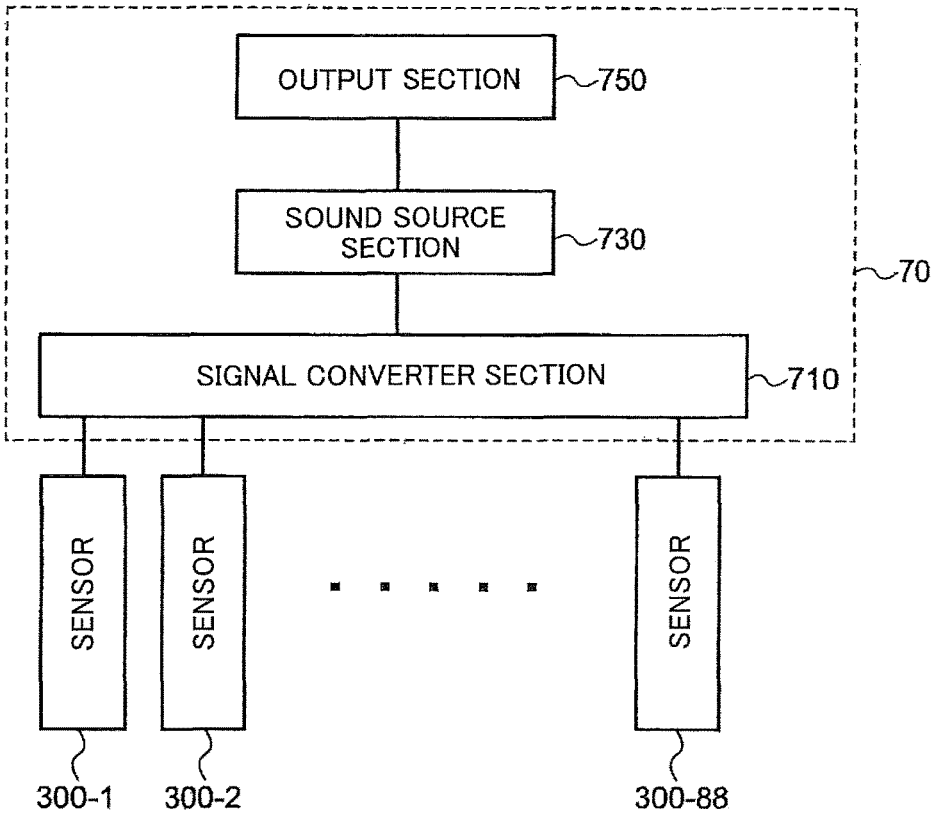
FIG. 2 is a block diagram illustrating a configuration of a sound source device in the first embodiment.

FIG. 2 is a block diagram illustrating the configuration of the sound source device in the first embodiment. The sound source device 70 includes a signal converter section 710, a sound source section 730, and an output section 750. Sensors 300 are provided corresponding to the respective keys 100. Each of the sensors 300 detects an operation of a corresponding one of the keys 100 and outputs signals in accordance with the detection. In the present example, each of the sensors 300 outputs signals in accordance with three levels of key pressing amounts. The speed of the key pressing is detectable in accordance with a time interval between the signals.

The signal converter section 710 obtains the signals output from the sensors 300 (the sensors 300-1, 300-2, . . . , 300-88 corresponding to the respective 88 keys 100) and creates and outputs an operation signal in accordance with an operation state of each of the keys 100. In the present example, the operation signal is a MIDI signal. Thus, the signal converter section 710 outputs "Note-On" when a key is pressed. In this output, a key number indicating which one of the 88 keys 100 is operated, and a velocity corresponding to the speed of the key pressing are also output in association with "Note-On". When the player has released the key 100, the signal converter section 710 outputs the key number and "Note-Off" in association with each other. A signal created in response to another operation, such as an operation on a pedal, may be output to the signal converter section 710 and reflected on the operation signal.

The sound source section 730 creates the sound waveform signal based on the operation signal output from the signal converter section 710. The output section 750 outputs the sound waveform signal created by the sound source section 730. This sound waveform signal is output to the speaker 80 or a sound-waveform-signal output terminal, for example.

Configuration of Keyboard Assembly

Figure 3:
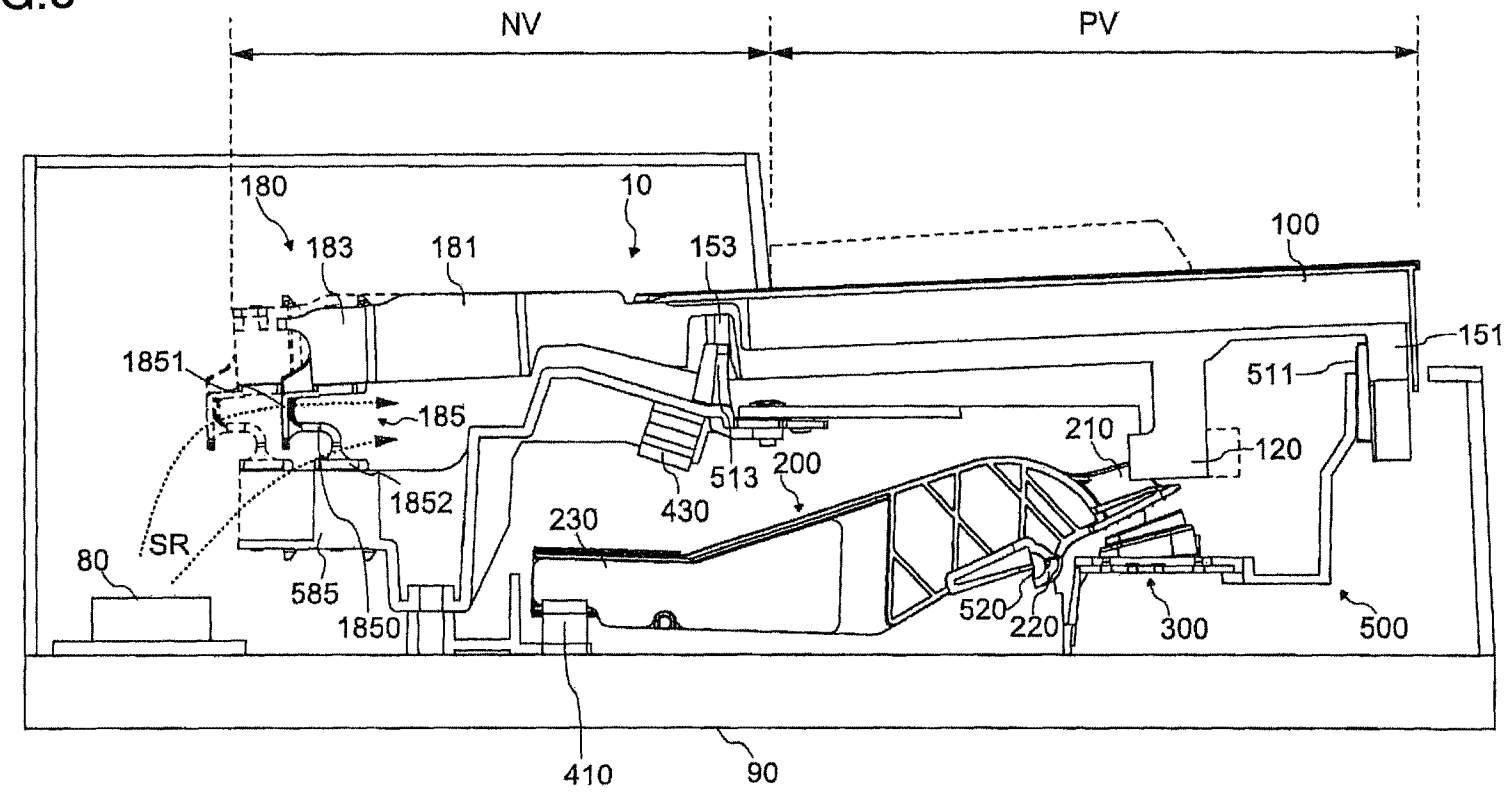
FIG. 3 is a view of a configuration of the inside of a housing in the first embodiment, with the configuration viewed from a lateral side of the housing.

FIG. 3 is a view of a configuration of the inside of the housing 90 in the first embodiment, with the configuration viewed from a lateral side of the housing 90. As illustrated in FIG. 3, the keyboard assembly 10 and the speaker 80 are disposed in the housing 90. That is, the housing 90 covers at least a portion of the keyboard assembly 10 (a connecting portion 180 and a frame 500) and the speaker 80. The speaker 80 is disposed at a back portion of the keyboard assembly 10. This speaker 80 is disposed so as to output a sound, which is produced in response to pressing of the key 100, toward up and down sides of the housing 90. The sound output downward travels toward the outside from a portion of the housing 90 near its lower surface. The sound output upward passes from the inside of the housing 90 through a space in the keyboard assembly 10 and travels to the outside from a space between the housing 90 and the keys 100 or from spaces each located between adjacent two of the keys 100 at the visible portion PV. It is noted that paths SR are one example of paths of sounds output from the speaker 80.

There will be next described a configuration of the keyboard assembly 10 with reference to FIG. 3. In addition to the keys 100, the keyboard assembly 10 includes the connecting portion 180, a hammer assembly 200, and the frame 500. The keyboard assembly 10 is formed of resin, and a most portion of the keyboard assembly 10 is manufactured by, e.g., injection molding. The frame 500 is fixed to the housing 90. The connecting portion 180 connects the keys 100 to the frame 500 such that the keys 100 are pivotable. The connecting portion 180 includes plate-like flexible members 181, first supporters 183, and turnable portions 185. Thus, the connecting portion 180 may include a component which moves with the key 100 as a unit and may further include a component which moves with the frame 500 as a unit. Each of the plate-like flexible members 181 extends from a rear end of a corresponding one of the keys 100. Each of the first supporters 183 extends from a rear end of a corresponding one of the plate-like flexible members 181.

Each of the turnable portions 185 includes a rod-like flexible member 1850, a key-side supporter 1851, and a frame-side supporter 1852. The key-side supporter 1851 supports one end of the rod-like flexible member 1850. In the present embodiment, the key-side supporter 1851 is connected to a component (the first supporter 183 in the present embodiment) having a fixed positional relationship with the key 100. The key-side supporter 1851 includes a component extending downward and supports one end (a back end) of the rod-like flexible member 1850. The frame-side supporter 1852 supports the other end (a front end) of the rod-like flexible member 1850. The detailed configuration of the turnable portions 185 will be described below.

The rod-like flexible member 1850 is formed of a flexible material and shaped like a bent rod. That is, a neutral axis of the rod-like flexible member 1850 at least has a bent portion in a state in which no power is applied to the neutral axis. In the present embodiment, the neutral axis of the rod-like flexible member 1850 at least has a bent portion at the entire movable area of the key 100 (the entire key pressing area). The flexibility enables the rod-like flexible member 1850 to be bent and twisted in various directions. The detailed configuration of the rod-like flexible member 1850 will be described below. The key-side supporter 1851 and the frame-side supporter 1852 are formed of a material that is the same in properties as that of the rod-like flexible member 1850, while the key-side supporter 1851 and the frame-side supporter 1852 are stiffer than the rod-like flexible member 1850. A positional relationship between the key-side supporter 1851 and the frame-side supporter 1852 changes with deformation of the rod-like flexible member 1850. When the rod-like flexible member 1850 is bent, the key-side supporter 1851 moves upward with respect to the frame-side supporter 1852, allowing the key 100 to pivot with respect to the frame 500 (see FIGS. 11A and 11B).

Each of the turnable portions 185 is supported by a corresponding one of the first supporters 183 and a corresponding one of second supporters 585 of the frame 500. The first supporter 183 and the key-side supporter 1851 are connected to each other attachably and detachably. The second supporter 585 and the frame-side supporter 1852 are connected to each other attachably and detachably. The attachable and detachable configuration facilitates manufacturing (such as a design of a metal mold, assembly, and repair) and improves a touch feeling and the strength due to combination of the materials. It is noted that the turnable portion 185 may be integral with at least one of the first supporter 183 and the second supporter 585 or bonded so as not to be attached or detached. It is further noted that the following description will be provided for each of the keys 100 for simplicity unless otherwise required.

The plate-like flexible member 181 and the first supporter 183 are molded integrally with the key 100 and formed of a material having the same properties as those of the material of the key 100. The frame 500 is also formed of a material having the same properties as those of the material of the plate-like flexible member 181 but may be formed of a material having properties different from those of the material of the plate-like flexible member 181. The turnable portion 185 (the rod-like flexible member 1850) is formed of a material having properties different from those of the material of the plate-like flexible member 181 but may be formed of a material having the same properties as those of the material of the plate-like flexible member 181. In the present embodiment, the plate-like flexible member 181 is harder than the rod-like flexible member 1850.

The key 100 includes a front-end key guide 151 and a side-surface key guide 153. The front-end key guide 151 is in slidable contact with a front-end frame guide 511 of the frame 500 in a state in which the front-end key guide 151 covers the front-end frame guide 511. The front-end key guide 151 is in contact with the front-end frame guide 511 at opposite side portions of upper and lower portions of the front-end key guide 151 in the scale direction. The upper portion of the front-end key guide 151 corresponds to an upper-portion key guide 151*u*, and the lower portion of the front-end key guide 151 corresponds to a lower-portion key guide 151*d* (see FIG. 6B). The side-surface key guide 153 is in slidable contact with a side-surface frame guide 513 at opposite side portions of the side-surface key guide 153 in the scale direction. In the present embodiment, the side-surface key guide 153 is disposed at portions of side surfaces of the key 100 which correspond to the non-visible portion NV, and the side-surface key guide 153 is nearer to the front end of the key 100 than the connecting portion 180 (the plate-like flexible member 181), but the side-surface key guide 153 may be disposed at a region corresponding to the visible portion PV.

The hammer assembly 200 is disposed at a space under the key 100 and attached so as to be pivotable with respect to the frame 500. A bearing 220 of the hammer assembly 200 and a pivot shaft 520 of the frame 500 are in slidable contact with each other at at least three points. A front end portion 210 of the hammer assembly 200 is located in an inner space of a hammer supporter 120 and in contact with the hammer supporter 120 slidably substantially in the front and rear direction. This sliding portion of the front end portion 210, i.e., portions of the front end portion 210 and the hammer supporter 120 which are in contact with each other, are located under the key 100 at the visible portion PV (located in front of a rear end of the key main body portion).

The hammer assembly 200 is provided with a metal weight 230 disposed on a back side of the pivot shaft 520. In a normal state (i.e., a state in which the key 100 is not pressed), the weight 230 is placed on a lower stopper 410, and the front end portion 210 of the hammer assembly 200 pushes the key 100 upward. When the key 100 is pressed, the weight 230 moves upward and comes into contact with an upper stopper 430. The hammer assembly 200 adds a weight to key pressing by the weight 230. The lower stopper 410 and the upper stopper 430 are formed of a cushioning material such as a nonwoven fabric and a resilient material, for example.

The sensor 300 is attached to the frame 500 under the hammer supporter 120 and the front end portion 210. When the key 100 is pressed, a lower surface of the front end portion 210 deforms the sensor 300, causing the sensor 300 to output detection signals. As described above, the sensors 300 are provided for the respective keys 100.

Figure 4:
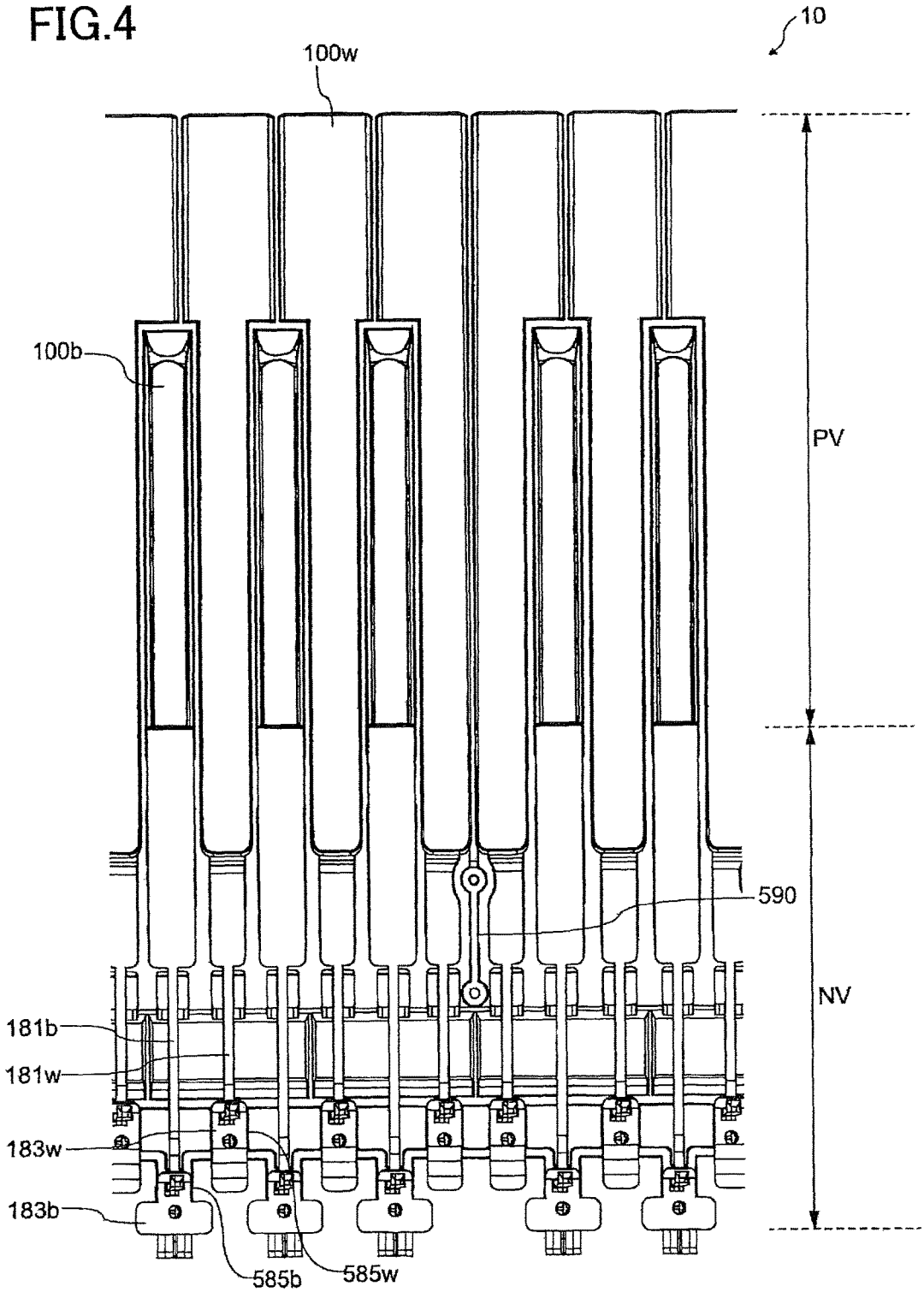
FIG. 4 is a view of a keyboard assembly in the first embodiment, with keyboard assembly viewed from an upper side thereof.
Figure 5:
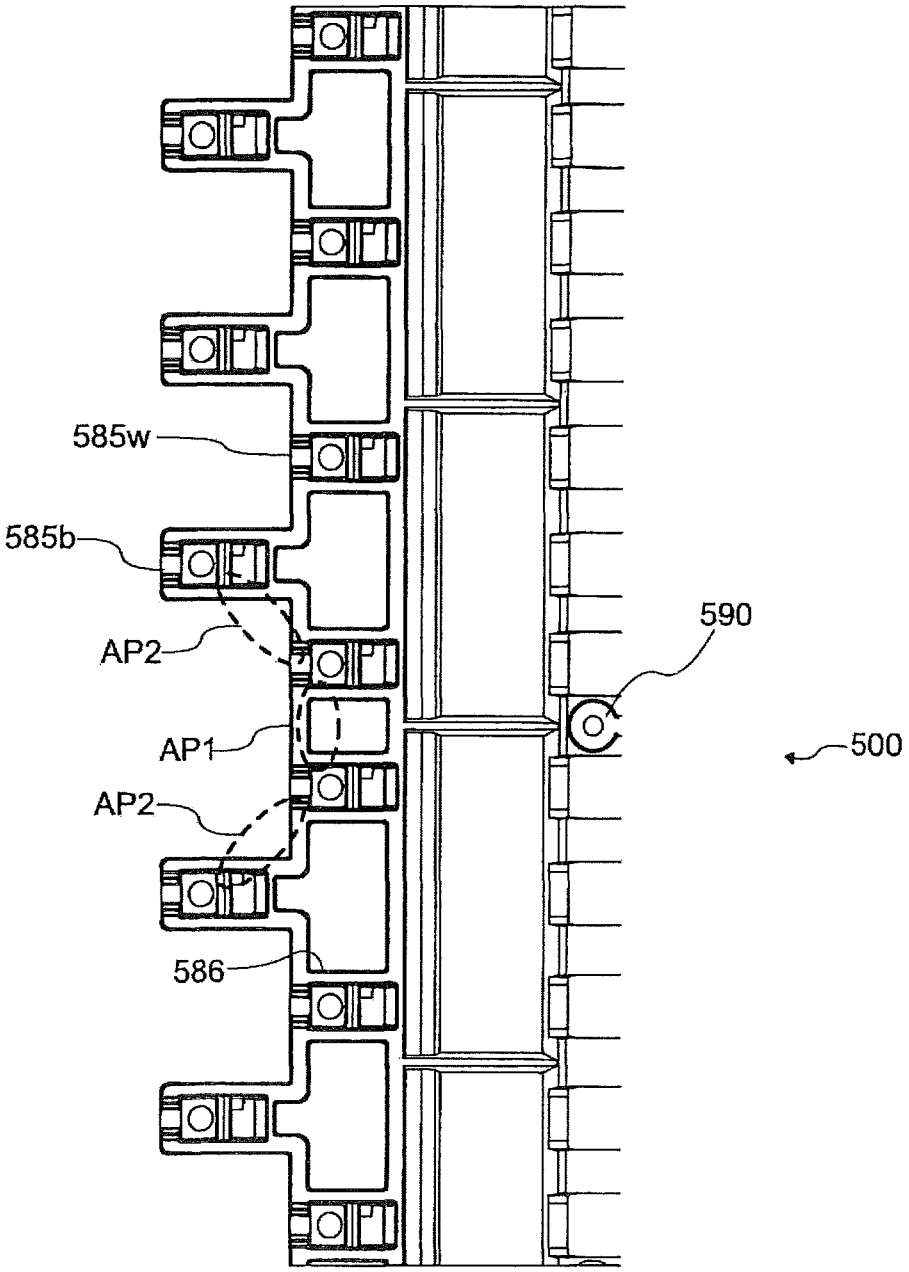
FIG. 5 is a view of a portion of the frame to which the turnable portion is connected in the first embodiment, with the portion viewed from an upper side thereof.

FIG. 4 is a view of the keyboard assembly 10 in the first embodiment, with keyboard assembly 10 viewed from an upper side thereof. FIG. 5 is a view of a portion of the frame 500 to which the turnable portion 185 is connected in the first embodiment, with the portion viewed from an upper side thereof. It is noted that these figures omit portions of the configurations of the hammer assembly 200 and the frame 500 located under the key 100. Specifically, FIGS. 4 and 5 illustrate the configuration of the frame 500 near the connecting portion 180 (e.g., the second supporters 585) and partly omits a front portion of the configuration. The other figures may partly omit configurations as needed.

As illustrated in FIG. 4, a first supporter 183*b* is disposed on a back side of a first supporter 183*w*. The position of each of the first supporter 183*b* and the first supporter 183*w* relates to the rod-like flexible member 1850 about which the key 100 pivots. This arrangement reproduces a difference in pivot center between a white key and a black key of an acoustic piano. In the present embodiment, a plate-like flexible member 181*b* corresponding to the black key is longer than a plate-like flexible member 181*w* corresponding to the white key. Thus, a second supporter 585*b* of the frame 500 is disposed on a back side of a second supporter 585*w* of the frame 500. Accordingly, as illustrated in FIG. 5, a back portion of the frame 500 (i.e., the second supporter 585) is shaped such that the second supporter 585*b* is located on a back side of the second supporter 585*w*.

Though FIG. 5 does not illustrate the turnable portions 185, there is a large space between each adjacent two of the turnable portions 185, especially between each adjacent two of the rod-like flexible members 1850. This space corresponds to sound passages AP1, AP2 illustrated in FIG. 5. A sound output from the speaker 80 travels from the outside to the inside of the keyboard assembly 10 through the sound passages AP1, AP2 and then travels to the outside of the keyboard apparatus 1 through a space between adjacent two of the keys 100. Due to the rod-like flexible member 1850, few components that interrupt a travel of the sound are provided between the frame 500 (the second supporter 585) and the connecting portion 180 (the first supporter 183) in a path through which the sound travels and is emitted from the visible portion PV to the outside, resulting in reduced amount of damping of the sound. Also, since the second supporters 585*b* are located on a back side of the second supporters 585*w*, the sound passage AP2 located between the second supporters 585*w*, 585*b* adjacent to each other is wider than the sound passage AP1 located between the two second supporter 585*w* adjacent to each other. Furthermore, an opening 586 may be formed in front of the second supporter 585*b* at a position located next to the second supporter 585*w* in the scale direction. In this configuration, this opening 586 may also serve as a sound passage.

Supports 590 are connected to the housing 90 to position the frame 500 with respect to the housing 90. Each of the supports 590 is provided between corresponding adjacent two of the white keys 100*w* which are adjacent to each other in the non-visible portion NV. That is, each of the supports 590 is provided between the white key 100*w* (E) and the white key 100*w* (F) or between the white key 100*w* (B) and the white key 100*w* (C).

Configuration of White Key

FIGS. 6A-6D are views for explaining the configuration of the white key 100*w* in the first embodiment. FIG. 6A is a view of the white key 100*w* viewed from an upper side thereof. FIG. 6B is a view of the white key 100*w* viewed from a lateral (left) side thereof. FIG. 6C is a view of the white key 100*w* viewed from a back side thereof. FIG. 6D is a view of the white key 100*w* viewed from a front side thereof.

First, there will be defined directions used in the following description (the scale direction S, the rolling direction R, the yawing direction Y, the up and down direction V, and the front and rear direction F). As described above, the scale direction S corresponds to the direction in which the keys 100 are arranged (i.e., the right and left direction when the keyboard apparatus 1 is viewed from the player). The rolling direction R corresponds to a direction rolling about the direction in which the key 100 extends (i.e., the back direction when the keyboard apparatus 1 is viewed from the player). The yawing direction Y is a direction bent in the right and left direction when the key 100 is viewed from above. Though there is no large difference between the scale direction S and the yawing direction Y, movement of the key 100 in the scale direction S of the key 100 means a translation of the key 100, and movement of the key 100 in the yawing direction Y means bending or warping of the key 100 in the scale direction S. The up and down direction V corresponds to the up and down direction when the keyboard apparatus 1 is viewed from the player. The up and down direction V serves as an axis for bending of the yawing direction Y. The front and rear direction F corresponds to the direction in which the key 100 extends (i.e., the back direction when the keyboard apparatus 1 is viewed from the player). The front and rear direction F also serves an axis for the roll of the rolling direction R. It is noted that the front and rear direction F is a direction (included in the horizontal plane) orthogonal to both of the up and down direction V and the scale direction S, and strictly the front and rear direction F is different from but substantially coincides with the direction in which the key 100 located at its rest position extends.

The key 100 is provided with the front-end key guide 151 and the side-surface key guide 153. As described above, the upper and lower portions of the front-end key guide 151 contact the front-end frame guide 511 of the frame 500 (see FIG. 3) in the scale direction. Thus, the front-end key guide 151 is divided into the upper-portion key guide 151*u* and the lower-portion key guide 151*d* in reality. In the case where the key 100 is viewed in the scale direction S, the front-end key guide 151 (the upper-portion key guide 151*u* and the lower-portion key guide 151*d*) and the side-surface key guide 153 restrict movement of the key 100 at three points that are not arranged on a straight line. The at least three guides arranged in this manner restrict movement of the key 100 in the scale direction S, the yawing direction Y, and the rolling direction R. In the present embodiment, the side-surface key guide 153 includes protrusions 1531, 1533 and a groove 1535 defined by the protrusions 1531, 1533, and the side-surface frame guide 513 slides in the groove 1535, thereby restricting movement of the key 100 in the front and rear direction. The number of the guides may be greater than two. In this case, it is not required that all the guides are not arranged on a straight line, and at least three guides only has to be not arranged on a straight line.

The plate-like flexible member 181 is a plate-like member having flexibility in the scale direction S. The plate-like flexible member 181 is disposed such that a direction of a normal N to a plate surface of the plate-like flexible member 181 is directed toward the scale direction S. With this configuration, the plate-like flexible member 181 is deformable in the rolling direction R and the yawing direction Y by bending or twisting. That is, the flexibility of the plate-like flexible member 181 gives the plate-like flexible member 181 freedom in the rolling direction R and the yawing direction Y of the key 100. Combination of deformation in the yawing direction Y and deformation in the rolling direction R gives the plate-like flexible member 181 freedom in the scale direction S. The plate-like flexible member 181 is hardly deformed in the up and down direction. It is noted that the direction of the normal N may not completely coincide with the scale direction S and only has to have a component of the scale direction S. In the case where the direction of the normal N does not completely coincide with the scale direction S, the angle between the direction of the normal N and the scale direction S is preferably smaller.

The rod-like flexible member 1850 is deformable in the rolling direction R and the yawing direction Y by bending or twisting. That is, the flexibility of the rod-like flexible member 1850 gives the rod-like flexible member 1850 freedom in the rolling direction R and the yawing direction Y of the key 100. Combination of deformation in the yawing direction Y and deformation in the rolling direction R gives the rod-like flexible member 1850 freedom in the scale direction S. The rod-like flexible member 1850 is also deformable in the front and rear direction F and in the up and down direction V. It is noted that a twistable amount of the rod-like flexible member 1850 is greater than that of the plate-like flexible member 181 due to the property of the shape of the rod-like flexible member 1850.

Thus, the connecting portion 180 is not only configured to cause pivotal movement of the key 100 with respect to the frame 500 in a pitch direction but also deformable in the rolling direction R and the yawing direction Y. That is, the connecting portion 180 has freedom in the rolling direction R and the yawing direction Y of the key 100. As described above, combination of the deformation of the yawing direction Y and the deformation in the rolling direction R gives the connecting portion 180 freedom in the scale direction S.

As described above, the key 100 may be deformed in directions including the yawing direction Y and the rolling direction R due to manufacturing error in the key 100 and changes in the key 100 with time. Between the front-end key guide 151 and the side-surface key guide 153, in this deformation, effects caused by the deformation of the key 100 are not visibly recognized as possible at the visible portion PV by the restriction of the front-end key guide 151 and the side-surface key guide 153. Since the effects caused by the deformation are reduced at the visible portion PV, the non-visible portion NV is greatly affected by the deformation. The longer the key 100, the greater the effects are.

As a first example, it is assumed that the key 100 is gradually twisted (in other words, the key 100 is gradually deformed in the rolling direction R). In this case, the upper-portion key guide 151*u* and the lower-portion key guide 151*d* restrict movement of the key 100 such that the rolling direction R of a front end portion of the key 100 becomes the vertical direction. Thus, a back portion of the key 100 is more greatly affected by deformation of the key 100 in the rolling direction R than a front portion of the key 100. As a second example, it is assumed that the key 100 is gradually bent in the scale direction S (in other words, the key 100 is gradually deformed in the yawing direction Y). In this case, the front-end key guide 151 and the side-surface key guide 153 restrict the position of the key 100 in the scale direction S at the visible portion PV. Thus, the back portion of the key 100 is more greatly affected by deformation of the key 100 in the yawing direction Y than the front portion of the key 100.

In any of the cases, the pivot center of the key 100 and the position of the frame 500 deviate from each other due to the effects caused by deformation of the key 100. That is, a positional relationship between the second supporter 585 and the connecting portion 180 (the first supporter 183) connected to the key 100 changes.

In the key 100 in the first embodiment, the plate-like flexible member 181 and the rod-like flexible member 1850 are deformable due to their flexibility. Thus, effects caused by deviation between the key 100 and the second supporter 585 can be reduced by deformation of the connecting portion 180 (the plate-like flexible member 181 and the rod-like flexible member 1850). In this operation, the rod-like flexible member 1850 has not only a function as a component for causing pivotal movement of the key 100 in the pitch direction but also a function as a component for absorbing effects caused by deformation of the key 100. In this operation, in the case where the side-surface key guide 153 and the side-surface frame guide 513 restrict movement of the key 100 in the front and rear direction, it is possible to reduce effects caused by deformation of the rod-like flexible member 1850 in the front and rear direction F, thereby stabilizing pivotal movement of the key 100 in the pitch direction.

Also, as described above, since the effects caused by the deformation of the key 100 are not visibly recognized as possible at the visible portion PV, positional accuracy in the scale direction S is high. Thus, the front end portion 210 of the hammer assembly 200 which is detected by the sensor 300 and the hammer supporter 120 of the key 100 which is connected to the front end portion 210 are preferably provided under the key 100 at the visible portion PV (in front of the rear end of the key main body portion).

Configuration of Turnable Portion

There will be next described the configuration of the turnable portion 185. In the present embodiment, the turnable portion 185 is attachable to and detachable from the first supporter 183 and the second supporter 585.

Figure 7:
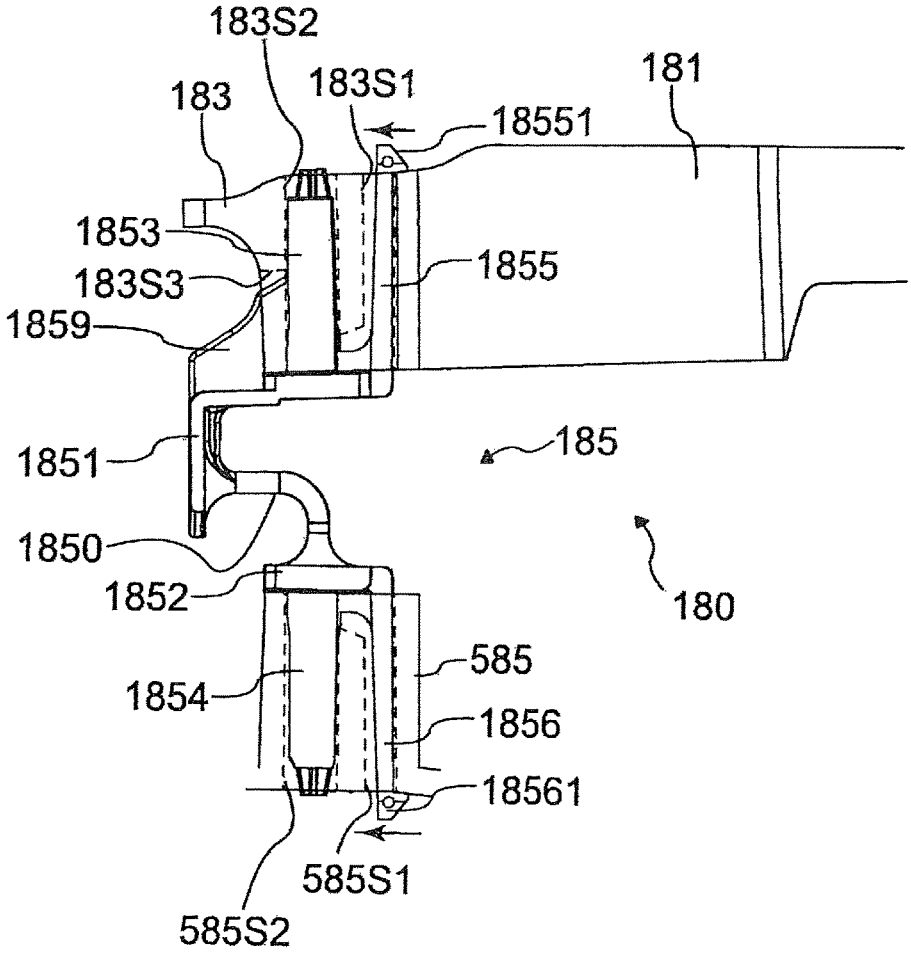
FIG. 7 is a view for explaining a configuration of the turnable portion in the first embodiment.

FIG. 7 is a view for explaining the configuration of the turnable portion in the first embodiment. FIG. 7 is an enlarged view of an area near the connecting portion 180 in FIG. 6B. In FIG. 7, a portion of the turnable portion 185 which is located in the first supporter 183 and the second supporter 585 is also indicated by the solid lines. A space formed in the first supporter 183 and the second supporter 585 is indicated by the broken lines.

The first supporter 183 has a first space 183S1 and a second space 183S2 formed through the first supporter 183 in the up and down direction. A third space 183S3 is connected to a rear end of the second space 183S2. An engaging rod 1855 is disposed in the first space 183S1, and a support rod 1853 is disposed in the second space 183S2. The support rod 1853 is inserted in the second space 183S2 from a lower side thereof. The engaging rod 1855 is inserted in the first space 183S1 from a lower side thereof. A top portion of the engaging rod 1855 has an engaging portion 18551. The engaging portion 18551 protrudes upward from the first space 183S1. The engaging portion 18551 is caught by an upper surface of the first supporter 183, whereby the engaging rod 1855 is not pulled out from the first supporter 183 by pivotal movement of the key 100. It is noted that the engaging rod 1855 has flexibility. The engaging rod 1855 may be disposed in the first space 183S1 in a state in which the engaging rod 1855 is bent toward the support rod 1853 (backward). When the engaging rod 1855 is deformed toward the support rod 1853 by pressing the engaging portion 18551 toward the support rod 1853, the engagement of the engaging rod 1855 with the first supporter 183 is canceled.

The support rod 1853 and the engaging rod 1855 are connected to the key-side supporter 1851. The key-side supporter 1851 includes: a plate-like member disposed along a lower surface of the first supporter 183; and a component extending downward from the plate-like member. In the present embodiment, a reinforcing plate 1859 is disposed to prevent changes in positional relationship between the support rod 1853 and the key-side supporter 1851. The reinforcing plate 1859 is a plate-like member connected to the key-side supporter 1851, and a portion of the reinforcing plate 1859 is disposed in the third space 183S3.

The second supporter 585 has a first space 585S1 and a second space 585S2 formed through the second supporter 585 in the up and down direction. An engaging rod 1856 is disposed in the first space 585S1, and a support rod 1854 is disposed in the second space 585S2. The support rod 1854 is inserted in the second space 585S2 from an upper side thereof. The engaging rod 1856 is inserted in the first space 585S1 from an upper side thereof. A top portion of the engaging rod 1856 has an engaging portion 18561. The engaging portion 18561 protrudes downward from the first space 585S1. The engaging portion 18561 is caught by a lower surface of the second supporter 585, whereby the engaging rod 1856 is not pulled out from the second supporter 585 by pivotal movement of the key 100. It is noted that the engaging rod 1856 has flexibility. The engaging rod 1856 may be disposed in the first space 585S1 in a state in which the engaging rod 1856 is bent toward the support rod 1854 (backward). When the engaging rod 1856 is deformed toward the support rod 1854 by pressing the engaging portion 18561 toward the support rod 1854, the engagement of the engaging rod 1856 with the second supporter 585 is canceled.

The support rod 1854 and the engaging rod 1856 are connected to a lower surface of the frame-side supporter 1852. The frame-side supporter 1852 is a plate-like member disposed along an upper surface of the second supporter 585. The rod-like flexible member 1850 is connected to an upper surface of the frame-side supporter 1852.

Method of Attaching and Detaching Turnable Portion

There will be next described a method of detaching the turnable portion 185 from the first supporter 183 and the second supporter 585.

Figure 8:
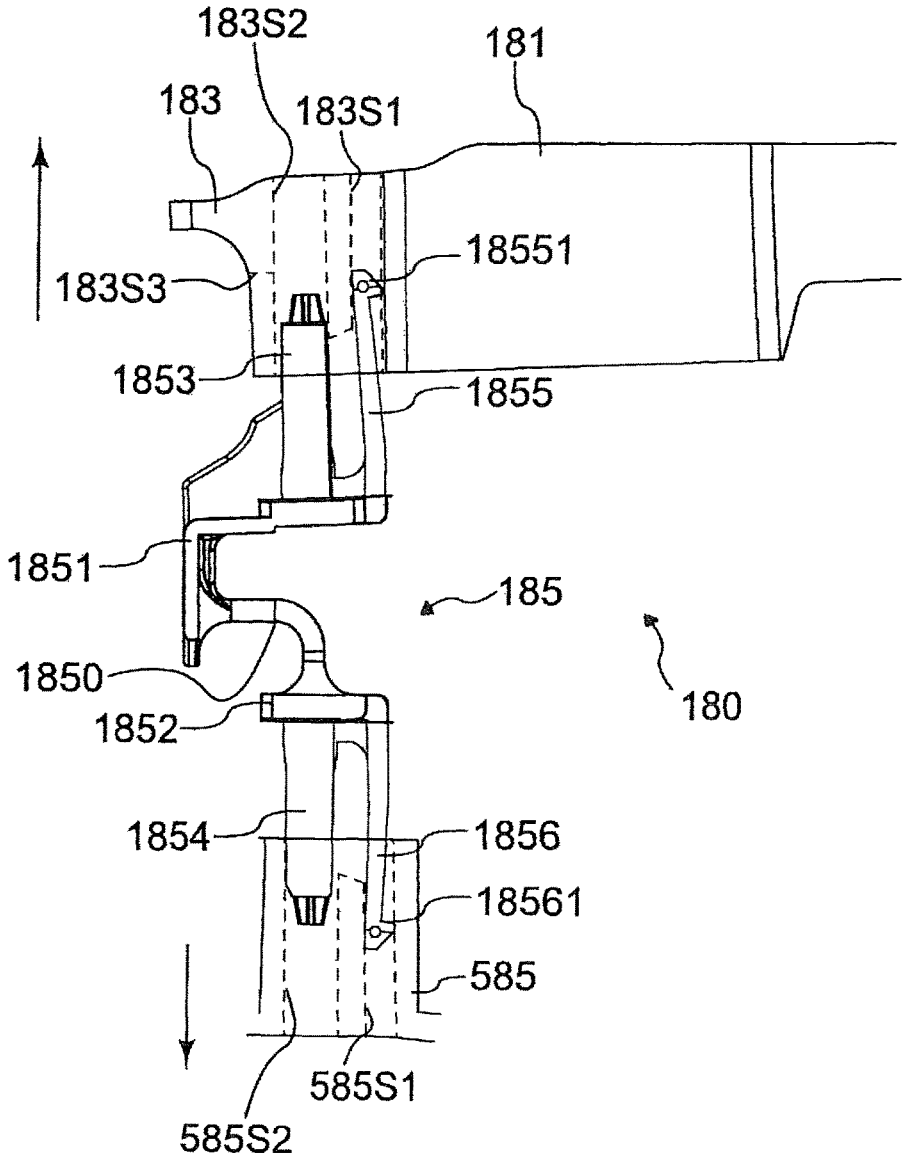
FIG. 8 is a view for explaining a method of detaching the turnable portion from other components in the first embodiment.

FIG. 8 is a view for explaining a method of detaching the turnable portion from other components in the first embodiment. More specifically, FIG. 8 is a view for explaining a middle of detachment of the turnable portion 185 from the first supporter 183 and the second supporter 585. When a force is applied to the engaging portion 18551 toward the support rod 1853, the flexible engaging rod 1855 is bent to move the engaging portion 18551 to a position at which the engaging portion 18551 can be pushed into the first space 183S1. When the first supporter 183 is moved upward with respect to the turnable portion 185, the engaging portion 18551 moves in the first space 183S1. When the first supporter 183 is further moved upward, the first supporter 183 and the turnable portion 185 are separated from each other, and the shape of the engaging rod 1855 is returned into its original shape.

When the player attaches the turnable portion 185 to the first supporter 183, the first supporter 183 is moved downward in a state in which the support rod 1853 is inserted in the second space 183S2 from a lower side thereof, and the engaging portion 18551 is inserted in the first space 183S1 from a lower side thereof. Since a distal end of the engaging portion 18551 has an inclined surface, the engaging portion 18551 and the engaging rod 1855 are inserted into the first space 183S1 in a state in which the engaging rod 1855 is bent toward the support rod 1853. When the first supporter 183 is further moved downward, the engaging portion 18551 protrudes upward from the first space 183S1, the shape of the engaging rod 1855 is returned its original shape, and the engaging portion 18551 is engaged with the upper surface of the first supporter 183.

There will be next described a method of detaching the turnable portion 185 from the second supporter 585. This method is principally the same as the method of detaching the turnable portion 185 from the first supporter 183. When a force is applied to the engaging portion 18561 toward the support rod 1854, the flexible engaging rod 1856 is bent to move the engaging portion 18561 to a position at which the engaging portion 18561 can be pushed into the first space 585S1. When the second supporter 585 is moved downward with respect to the turnable portion 185, the engaging portion 18561 moves in the first space 585S1. When the second supporter 585 is further moved downward (the turnable portion 185 is moved upward), the second supporter 585 and the turnable portion 185 are separated from each other, and the shape of the engaging rod 1856 is returned into its original shape.

When the player attaches the turnable portion 185 to the second supporter 585, the second supporter 585 is moved upward (the turnable portion 185 is moved downward) in a state in which the support rod 1854 is inserted in the second space 585S2 from an upper side thereof, and the engaging portion 18561 is inserted in the first space 585S1 from an upper side thereof. Since a distal end of the engaging portion 18561 has an inclined surface, the engaging portion 18561 and the engaging rod 1856 are inserted into the first space 585S1 in a state in which the engaging rod 1856 is bent toward the support rod 1854. When the second supporter 585 is further moved upward (the turnable portion 185 is further moved downward), the engaging portion 18561 protrudes downward from the first space 585S1, the shape of the engaging rod 1856 is returned to its original shape, and the engaging portion 18561 is engaged with the lower surface of the second supporter 585.

It is noted that FIG. 8 illustrates a state in which the turnable portion 185 is being detached from each of the first supporter 183 and the second supporter 585, but the turnable portion 185 need not be detached from the first supporter 183 and the second supporter 585 at the same time. The rod-like flexible member 1850 may be detached from any of the first supporter 183 and the second supporter 585 first.

Configuration of Rod-Like Flexible Member

There will be next described the configuration of the rod-like flexible member 1850 in the turnable portion 185 in detail. As in the description provided above, the following description is provided using figures in which the rod-like flexible member 1850 is viewed in the scale direction.

Figure 9:
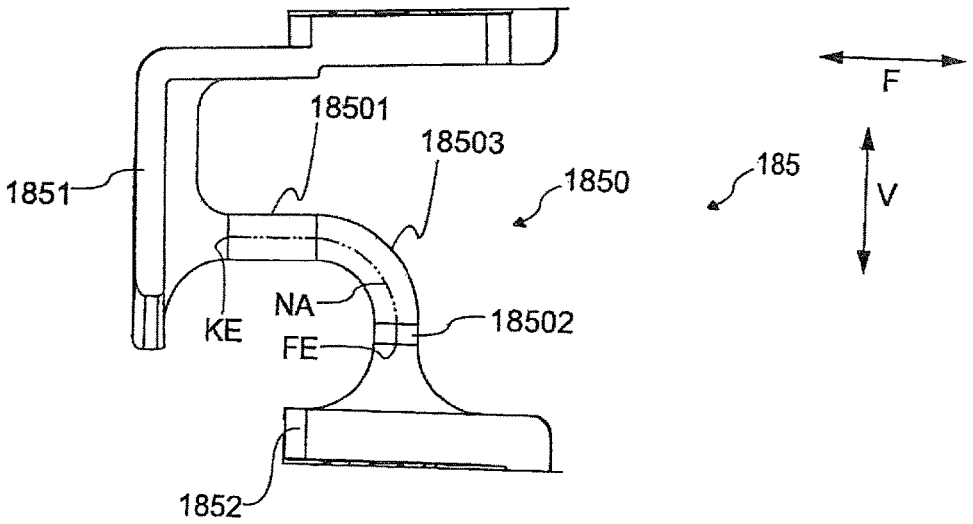
FIG. 9 is a view for explaining a configuration of a rod-like flexible member in the first embodiment.
Figure 10:
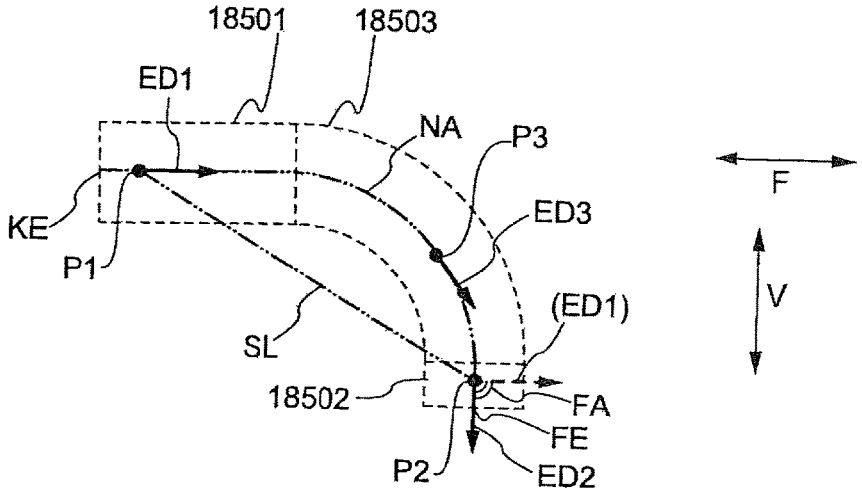
FIG. 10 is a view for explaining a detail of a characteristic configuration of the rod-like flexible member in the first embodiment.

FIG. 9 is a view for explaining the configuration of the rod-like flexible member 1850 in the first embodiment. The rod-like flexible member 1850 includes: a key-side end portion KE connected to the key-side supporter 1851; and a frame-side end portion FE connected to the frame-side supporter 1852. In the present embodiment, the rod-like flexible member 1850 includes a first straight rod portion 18501, a second straight rod portion 18502, and a curved rod portion 18503 (as one example of an intermediate rod portion). The first straight rod portion 18501 is connected at its one end (near the key-side end portion KE) to the key-side supporter 1851 and extends in the front and rear direction F. The second straight rod portion 18502 is connected at its one end (near the frame-side end portion FE) to the frame-side supporter 1852 and extends in the up and down direction V. The curved rod portion 18503 connects the first straight rod portion 18501 and the second straight rod portion 18502 to each other. A neutral axis NA is a collection of centers of figures of respective least cross sections. The center of the figure of each of the least cross sections is a centroid of the figure of a cross section in a direction (an inclination, an angle, a phase, or an orientation) in which the area of the cross section is smallest among cross sections of the rod-like flexible member 1850. It is noted that, in the present embodiment, the extending direction is defined with respect to a direction directed from the key-side end portion KE toward the frame-side end portion FE. It is noted that the neutral axis NA may be replaced with an axis (line) extending along the direction in which the rod-like flexible member 1850 extends (which may be hereinafter referred to as "extending direction of the rod-like flexible member 1850"). As illustrated in FIG. 10, an extending direction ED3 at the position P3 on the curved rod portion 18503 is different from an extending direction ED1 at a position P1 (i.e., a direction along the front and rear direction F) and from an extending direction ED2 at a position P2 (i.e., a direction along the up and down direction). At least a portion of the rod-like flexible member 1850 includes: the first straight rod portion 18501 extending in the front and rear direction F (i.e., the longitudinal direction of the key 100); the second straight rod portion 18502 extending in the up and down direction; and the curved rod portion 18503 connecting the first straight rod portion 18501 and the second straight rod portion 18502 to each other. The curved rod portion 18503 is disposed between the first straight rod portion 18501 and the second straight rod portion 18502 in the extending direction of the rod-like flexible member 1850. The curved rod portion 18503 extends in a direction different from the extending direction of the first straight rod portion 18501 (i.e., the longitudinal direction of the key 100) and the extending direction of the second straight rod portion 18502 (i.e., the up and down direction).

The cross-sectional shape of the rod-like flexible member 1850 (i.e., the shape of the cross section of the rod-like flexible member 1850 which is perpendicular to the extending direction (the neutral axis NA) of the rod-like flexible member 1850) is a round shape in the present embodiment. The cross-sectional shape of the rod-like flexible member 1850 is not limited to the round shape and may be any of (i) a shape defined only by a curve or curves, (ii) a shape (e.g., a semicircular shape) defined by combination of a curve or curves and a straight line or straight lines, and (iii) a shape (e.g., a rectangular shape) defined only by straight lines, for example. The rod-like flexible member 1850 may be shaped like a tube having a space therein. That is, the rod-like flexible member 1850 may have any cross-sectional shape as long as the rod-like flexible member 1850 can be bent in a direction perpendicular to the neutral axis NA and twisted about the neutral axis NA. In the present embodiment, the thickness of the rod-like flexible member 1850 (which corresponds to a distance between the neutral axis NA and a surface of the rod-like flexible member 1850) is the same at any position on the neutral axis NA. However, the thickness of the rod-like flexible member 1850 may change depending upon positions on the neutral axis NA. In the case where an outer edge of the cross-sectional shape of the rod-like flexible member 1850 is formed into a rectangular shape, a ratio between the lengths of two sides of the rectangular shape which are orthogonal to each other may be greater than or equal to three quarters or less than or equal to four thirds but is not limited to this range.

FIG. 10 is a view for explaining a detail of a characteristic configuration of the rod-like flexible member 1850 in the first embodiment. FIG. 10 illustrates only the rod-like flexible member 1850 of the turnable portion 185. The position P1 on the neutral axis NA at the first straight rod portion 18501, the position P2 on the neutral axis NA at the second straight rod portion 18502, and the position P3 on the neutral axis NA at the curved rod portion 18503 are defined as illustrated in FIG. 10 for the sake of convenience. Since the neutral axis NA is bent at the curved rod portion 18503 of the rod-like flexible member 1850, the length from the position P1 to the position P2 along the neutral axis NA (i.e., the length of a line along the neutral axis NA from the position P1 to the position P2 or the length of a portion of the neutral axis NA which is located between the position P1 and the position P2) is greater than that of a straight line SL connecting the position P1 and the position P2 to each other. In the present embodiment, this applies to a relationship between the position P1 and the position P3. This condition is satisfied over the entire area of the pivotal movement of the key 100 (i.e., the area from the rest position to an end position). That is, even when the rod-like flexible member 1850 is bent by a force applied thereto, the length from the position P1 to the position P2 along the neutral axis NA is kept greater than that of the straight line SL connecting the position P1 and the position P2 to each other.

In a state in which the key 100 is not pressed (that is, the key 100 is located at the rest position), the extending direction ED1 at the position P1 substantially coincides with the longitudinal direction of the key 100 (i.e., the front and rear direction F), and even in the case where the position P1 is changed in position in the longitudinal direction in the first straight rod portion 18501, the angle of the extending direction ED1 with respect to the longitudinal direction of the key 100 does not change. Also, the extending direction ED2 at the position P2 substantially coincides with a direction (the up and down direction V) perpendicular to the longitudinal direction of the key 100, and even in the case where the position P2 in the second straight rod portion 18502 is changed in position in the direction perpendicular to the longitudinal direction of the key 100, the angle of the extending direction ED2 with respect to the longitudinal direction of the key 100 does not change. In contrast, since the curved rod portion 18503 is curved, the extending direction ED3 at the position P3 changes such that the angle of the extending direction ED3 with respect to the longitudinal direction of the key 100 gradually increases with change in the position P3 from the first straight rod portion 18501 toward the second straight rod portion 18502. In the present embodiment, since the neutral axis NA is disposed along a plane on which the key 100 pivots, the straight line SL is disposed along the plane on which the key 100 pivots, and the extending direction changes along this plane. Thus, in the case where the rod-like flexible member 1850 is viewed from an upper side thereof, the rod-like flexible member 1850 has a rod shape extending in a straight line extending along the longitudinal direction of the key 100.

It is noted that, in at least a portion of the area of the pivotal movement of the key 100, the angle between the extending direction ED1 and the longitudinal direction of the key 100 is not limited to zero degree and may be greater than or equal to zero degree or less than 45 degrees, and the angle between the extending direction ED2 and the longitudinal direction of the key 100 is not limited to 90 degrees and may be greater than or equal to 45 degrees or less than 90 degrees. A change in the extending direction of the rod-like flexible member 1850 (e.g., a change in angle when the extending direction is changed from the extending direction ED1 to the extending direction ED2, which angle corresponds to an angle FA in FIG. 10) is 90 degrees in the present embodiment but may be less than or greater than 90 degrees. This change is preferably greater than or equal to 90 degrees to increase freedom with respect to various directions. While the straight line SL is disposed along the plane on which the key 100 pivots, the present disclosure is not limited to this configuration. For example, the straight line SL only has to have a component of a direction along the plane on which the key 100 pivots. That is, the neutral axis NA may be partly inclined with respect to the plane on which the key 100 pivots.

As described above, the connecting portion 180 is deformable in the rolling direction R and the yawing direction Y. Since the rod-like flexible member 1850 has the shape illustrated in FIGS. 9 and 10, various kinds of deformation can be performed on the respective regions. For example, when the rod-like flexible member 1850 is deformed in the rolling direction R, the first straight rod portion 18501 is twisted, and the second straight rod portion 18502 is bent. When the rod-like flexible member 1850 is deformed in the yawing direction Y, the first straight rod portion 18501 is bent, and the second straight rod portion 18502 is twisted. These deformations are partly caused in the curved rod portion 18503.

A heavy shearing load is imposed on the rod-like flexible member 1850 in response to particular key pressing such as depression of a back portion of the key 100 (near the connecting portion 180). The shorter a distance between the key-side end portion KE and the frame-side end portion FE of the rod-like flexible member 1850 in a straight line, the rod-like flexible member 1850 is more advantageous in configuration against a bending stress due to such a shearing load. The greater the length between the key-side end portion KE and the frame-side end portion FE along the rod-like flexible member 1850, e.g., the length of the neutral axis NA between the key-side end portion KE and the frame-side end portion FE, the flexible member 1850 is more advantageous for reducing a bending reaction force produced by the flexible member 1850. In the first embodiment, the distance along the neutral axis NA between the predetermined two points (i.e., the positions P1, P2 in the above-described example) in the rod-like flexible member 1850 is greater than the distance between the predetermined two points in a straight line, making it possible to support the key 100 pivotably with a small reaction force and improve the durability.

Operations of Keyboard Assembly

Figure 11A:
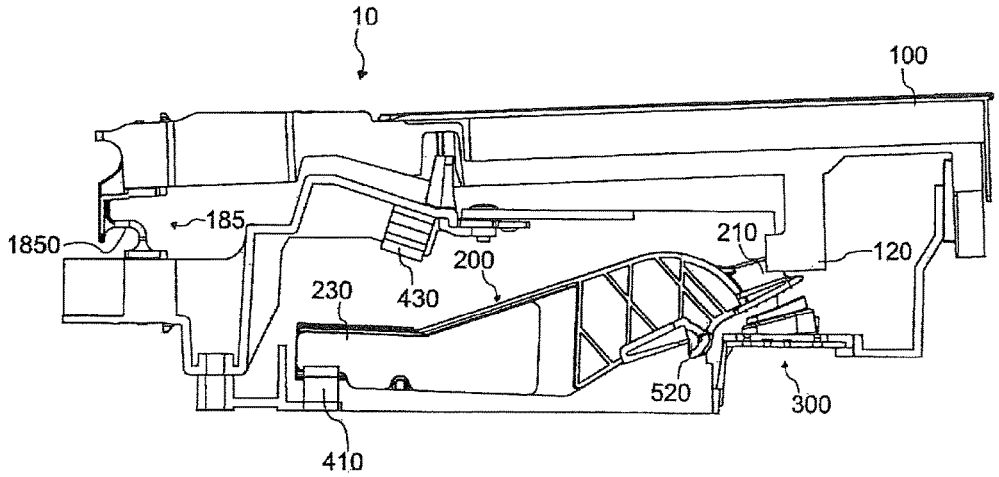
FIGS. 11A and 11B are views for explaining operations of a keyboard assembly when a key (the white key) is depressed in the first embodiment.
Figure 11B:
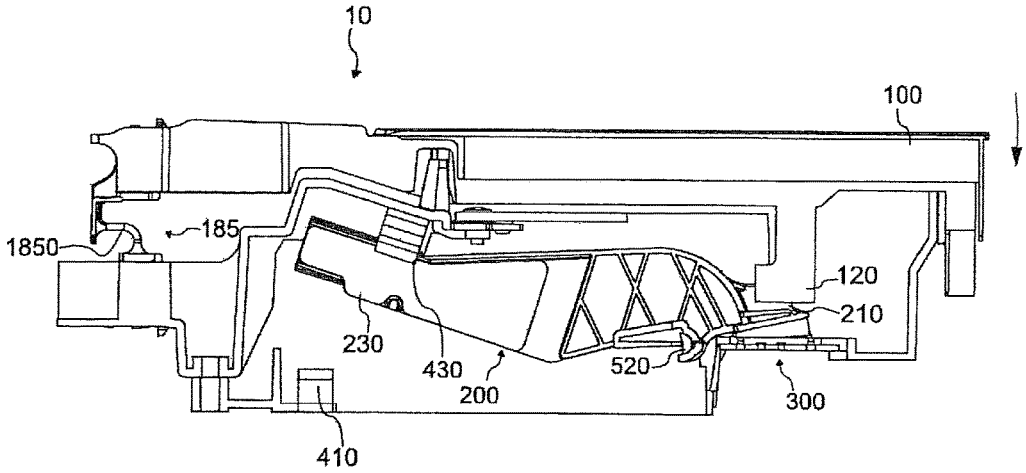

FIGS. 11A and 11B are views for explaining operations of the keyboard assembly 10 when the key 100 (the white key 100*w*) is depressed in the first embodiment. FIG. 11A illustrates a state in which the key 100 is located at the rest position (that is, the key 10 is not depressed). FIG. 11B illustrates a state in which the key 100 is located at the end position (that is, the key 10 is fully depressed). When the key 100 is pressed, the turnable portion 185, specifically, the rod-like flexible member 1850 is bent as a pivot center. Bending deformation is caused in the rod-like flexible member 1850. Thus, the key 100 pivots in the pitch direction. The hammer supporter 120 depresses the front end portion 210, causing pivotal movement of the hammer assembly 200 about the pivot shaft 520. When the weight 230 collides with the upper stopper 430, the pivotal movement of the hammer assembly 200 is stopped, and the key 100 reaches the end position. When the sensor 300 is deformed by the front end portion 210, the sensor 300 outputs the detection signals in accordance with the plurality of levels of an amount of deformation of the sensor 300 (i.e., the key pressing amount).

When the key 100 is released, the weight 230 moves downward, the hammer assembly 200 pivots, and the key 100 pivots upward. When the weight 230 comes into contact with the lower stopper 410, the pivotal movement of the hammer assembly 200 is stopped, and the key 100 is returned to the rest position.

As described above, the keyboard apparatus 1 according to the first embodiment connects the key 100 at the connecting portion 180 such that the key 100 pivotable in response to key pressing and key releasing. In the keyboard apparatus 1, movement of the key 100 is restricted by the front-end key guide 151 and the side-surface key guide 153, and the connecting portion 180 is deformable, thereby reducing effects on the visible portion PV due to manufacturing error in the key 100 and deformation of the key 100 due to changes with time.

Use of the rod-like flexible member 1850 enables one component to allow movement or deformation of the key 100 in various directions, that is, the rod-like flexible member 1850 is movable and deformable in various directions. In other words, the keyboard apparatus 1 according to the first embodiment uses the rod-like component having flexibility having a bent portion. This configuration reduces effects on the size of the keyboard apparatus 1 when compared with a conventional technique in which regions are defined for respective directions in which movement or deformation of the key is allowed, and a plurality of components are combined with each other. Also, as described above, it is possible to improve the durability of the rod-like flexible member 1850.

Second Embodiment

While the rod-like flexible member 1850 has the positional relationship in which the key-side end portion KE is located on an upper and back side of the frame-side end portion FE in the first embodiment, the positions of the key-side end portion KE and the frame-side end portion FE are not limited to this configuration. Also, while the rod-like flexible member 1850 has the direction relationship in which the neutral axis NA at the key-side end portion KE extends in the front and rear direction F, and the neutral axis NA at the frame-side end portion FE extends in the up and down direction V, the directions of the neutral axis NA are not limited to this configuration. In the second embodiment, the positional relationship and the direction relationship between the key-side end portion KE and the frame-side end portion FE are changed in the rod-like flexible member 1850 including the first straight rod portion 18501, the second straight rod portion 18502, and the curved rod portion 18503.

Figure 12A:
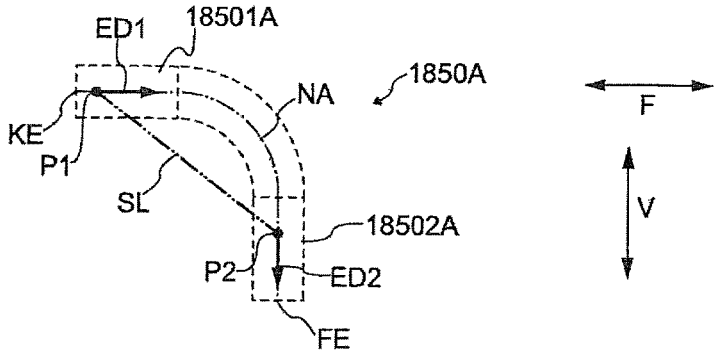
FIGS. 12A through 12D are views each for explaining a configuration of a rod-like flexible member in a second embodiment.

FIGS. 12A through 12D are views each for explaining a configuration of a rod-like flexible member in the second embodiment. FIG. 12A illustrates a rod-like flexible member 1850A in which the positional relationship between the key-side end portion KE and the frame-side end portion FE is the same as that in the first embodiment, but the length of a second straight rod portion 18502A is equal to the length of a first straight rod portion 18501A.

Figure 12B:
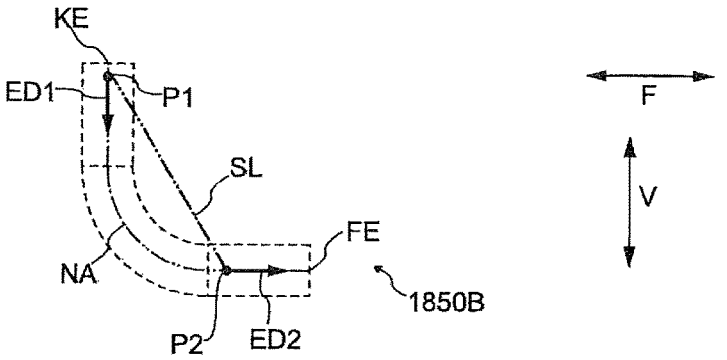

FIG. 12B illustrates a rod-like flexible member 1850B in which the above-described positional relationship is the same as that in the first embodiment, but a direction relationship between the key-side end portion KE and the frame-side end portion FE is different from that in the first embodiment. In this rod-like flexible member 1850B, the neutral axis NA at a portion (as one example of a second straight rod portion) of the flexible member 1850B which includes the key-side end portion KE extends in the up and down direction V, and the flexible member 1850B extends in the front and rear direction F at its frame-side end portion FE (as one example of a first straight rod portion).

Figure 12C:
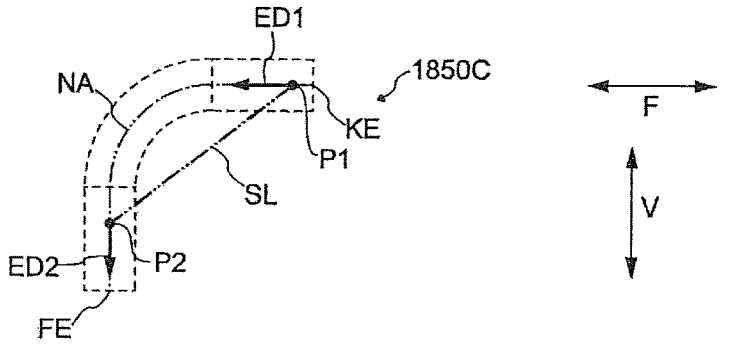

FIG. 12C illustrates a rod-like flexible member 1850C in which the above-described direction relationship is the same as that in the first embodiment, but the above-described positional relationship is different from that in the first embodiment. In this rod-like flexible member 1850C, a portion (as another example of the first straight rod portion) of the flexible member 1850C which includes the key-side end portion KE is located on an upper and front side of a portion (as another example of the second straight rod portion) of the flexible member 1850C which includes the frame-side end portion FE.

Figure 12D:
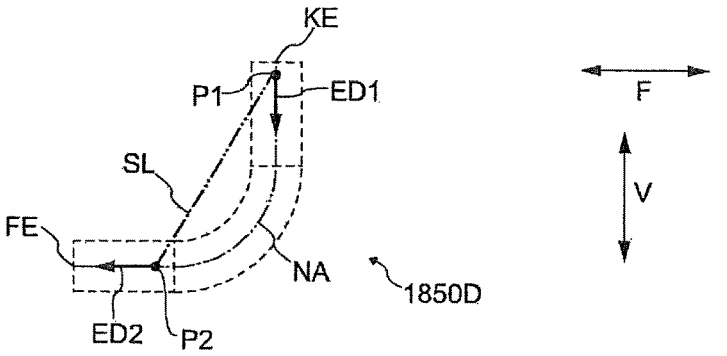

FIG. 12D illustrates a rod-like flexible member 1850D in which the above-described positional relationship and the above-described direction relationship are different from those in the first embodiment. In this rod-like flexible member 1850D, a portion (as another example of the second straight rod portion) of the flexible member 1850D which includes the key-side end portion KE is located on an upper and front side of a portion (as another example of the first straight rod portion) of the flexible member 1850D which includes the frame-side end portion FE. The neutral axis NA at the portion of rod-like flexible member 1850D which includes the key-side end portion KE extends in the up and down direction V, and the neutral axis NA at the portion of rod-like flexible member 1850D which includes the frame-side end portion FE extends in the front and rear direction F.

While the key 100 is located above the frame 500 in the above-described examples, the frame 500 may also be disposed above the key 100. In this case, each of the rod-like flexible members 1850A, 1850B, 1850C, 1850D only needs to be configured such that the portion of the rod-like flexible member which includes the key-side end portion KE and the portion of the rod-like flexible member which includes the frame-side end portion FE are replaced with each other.

Third Embodiment

In the first embodiment, the rod-like flexible member 1850 is configured such that the two straight rod portions (i.e., the first straight rod portion 18501 and the second straight rod portion 18502) are connected to each other by the one curved rod portion 18503, and the rod-like flexible member 1850 has the rod shape bent only in one direction. In the third embodiment, a rod-like flexible member has a rod shape bent in a plurality of directions.

Figure 13A:
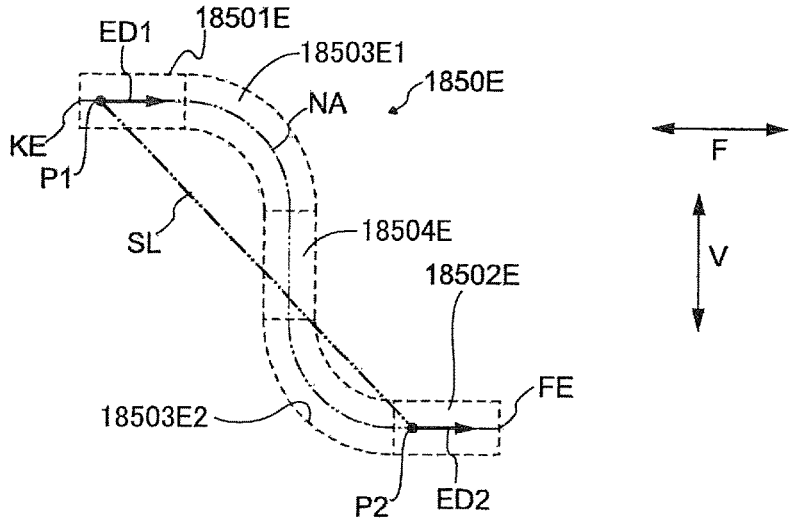
FIGS. 13A and 13B are views each for explaining a configuration of a rod-like flexible member a third embodiment.
Figure 13B:
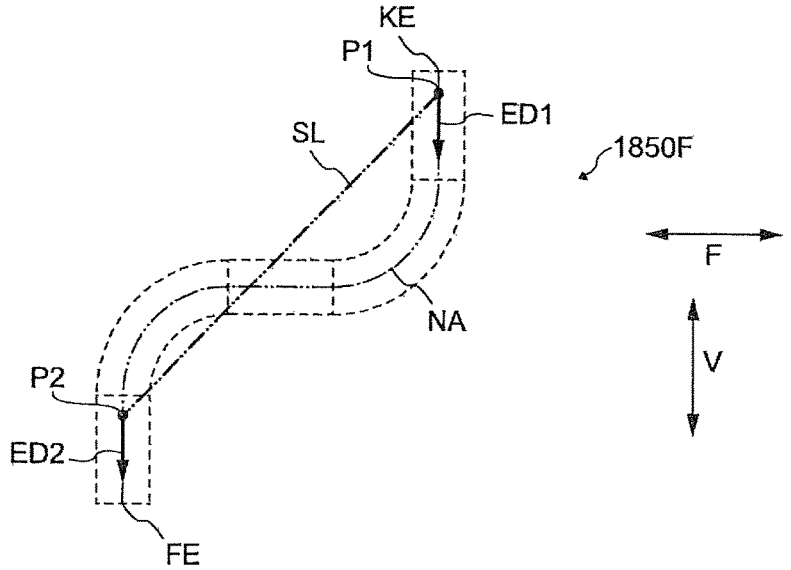

FIGS. 13A and 13B are views each for explaining a configuration of a rod-like flexible member in the third embodiment. In the present embodiment, there will be described rod-like flexible members 1850E, 1850F bent in different directions from each other and each including two curved rod portions. FIG. 13A illustrates a rod-like flexible member 1850E including two curved rod portions 18503E1, 18503E2 between a first straight rod portion 18501E and a first straight rod portion 18502E. In this rod-like flexible member 1850E, each of the neutral axis NA at a portion of the flexible member 1850E which includes the key-side end portion KE and the neutral axis NA at a portion of the flexible member 1850E which includes the frame-side end portion FE extends in the front and rear direction F. While a straight rod portion 18504E (as another example of the second straight rod portion) is disposed between the curved rod portion 18503E1 and the curved rod portion 18503E2 in this example, the two curved rod portions 18503E1, 18503E2 may be directly connected to each other.

FIG. 13B illustrates a rod-like flexible member 1850F formed by rotating the rod-like flexible member 1850E 90 degrees. In this rod-like flexible member 1850F, each of the neutral axis NA at a portion of the flexible member 1850F which includes the key-side end portion KE and the neutral axis NA at a portion of the flexible member 1850F which includes the frame-side end portion FE extends in the up and down direction V. Since the flexible member includes a plurality of the curved rod portions, the distance along the neutral axis NA between the predetermined two points (i.e., the positions P1, P2 or the key-side end portion KE and the frame-side end portion FE) in the flexible member is further greater than the distance between the two points in a straight line.

While each of the rod-like flexible members 1850E, 1850F includes the two curved rod portions in these examples, the rod-like flexible member may includes three or more curved rod portions. Also, the rod-like flexible member may be constituted only by curved rod portions without using any straight rod portion.

Fourth Embodiment

In the first embodiment, the rod-like flexible member 1850 is configured such that the two straight rod portions (i.e., the first straight rod portion 18501 and the second straight rod portion 18502) are connected to each other by the one curved rod portion 18503, and the neutral axis NA has a curve, whereby the rod-like flexible member 1850 has a bent rod shape. In a fourth embodiment, there will be described a rod-like flexible member 1850G including two straight rod portions directly connected to each other to form a bent rod shape.

Figure 14:
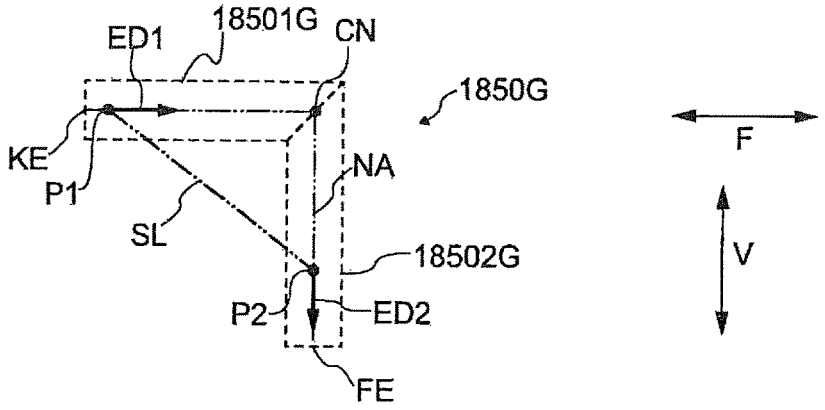
FIG. 14 is a view for explaining a configuration of a rod-like flexible member in a fourth embodiment.

FIG. 14 is a view for explaining a configuration of a rod-like flexible member in the fourth embodiment. In the present embodiment, a first straight rod portion 18501G and a second straight rod portion 18502G are directly connected to each other without a configuration corresponding to the above-described curved rod portion. Thus, in the rod-like flexible member 1850G in the fourth embodiment, the neutral axis NA has a corner portion CN, whereby the rod-like flexible member 1850G has a bent rod shape.

Fifth Embodiment

In the first embodiment, the area of the shape of the rod-like flexible member 1850 in cross section perpendicular to the neutral axis NA (i.e., the cross-sectional area of the rod-like flexible member 1850) is constant regardless of positions on the neutral axis NA. In the fifth embodiment, there will be described a rod-like flexible member 1850H in which this cross-sectional area varies with positions on the neutral axis NA.

Figure 15:
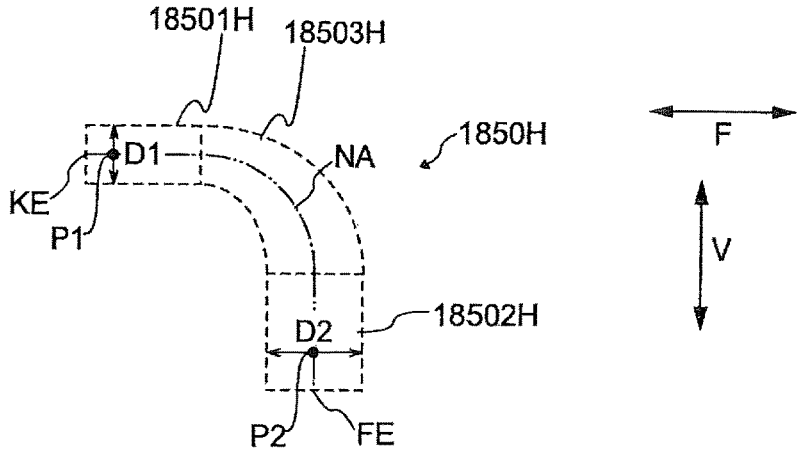
FIG. 15 is a view for explaining a configuration of a rod-like flexible member in a fifth embodiment.

FIG. 15 is a view for explaining a configuration of a rod-like flexible member in the fifth embodiment. In the present embodiment, the diameter D1 of a first straight rod portion 18501H at the position P1 and the diameter D2 of a second straight rod portion 18502H at the position P2 are different from each other. That is, the cross-sectional area of the rod-like flexible member 1850H is different between the position P1 and the position P2. The rod-like flexible member 1850H includes a curved rod portion 18503H connecting the first straight rod portion 18501H and the second straight rod portion 18502H to each other, and the diameter of this curved rod portion 18503H gradually changes, whereby the diameter of the curved rod portion 18503H changes from the diameter D1 to the diameter D2.

Bending properties, the durability, and so on of the rod-like flexible member can be set variously, depending upon which position a portion having a large cross-sectional area is located at. It is noted that the cross-sectional area may vary in one straight rod portion, with positions on the neutral axis NA. The rod-like flexible member may be configured such that the cross-sectional area varies in the curved rod portion with positions on the neutral axis NA, and a plurality of straight rod portions have the same cross-sectional area.

Sixth Embodiment

In the first embodiment, the extending direction of the curved rod portion 18503 is changed by 90 degrees. In a sixth embodiment, there will be described a rod-like flexible member 1850J including a curved rod portion that changes the extending direction by an angle greater than or equal to 90 degrees.

Figure 16:
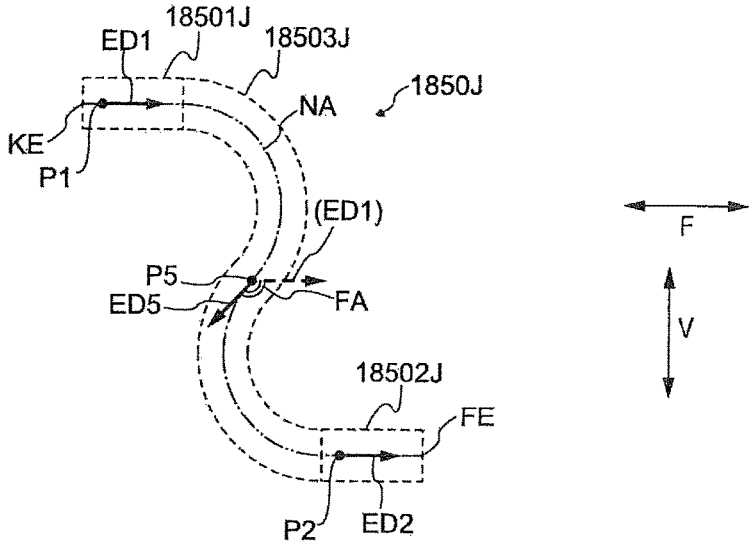
FIG. 16 is a view for explaining a configuration of a rod-like flexible member in a sixth embodiment.

FIG. 16 is a view for explaining a configuration of a rod-like flexible member in the sixth embodiment. In the present embodiment, a curved rod portion 18503J is located between a first straight rod portion 18501J and a first straight rod portion 18502J. The curved rod portion 18503J includes a position P5 that is an inflection point of the bent neutral axis NA. A change in angle of the extending direction with respect to the extending direction ED1 at the position P1 is greatest at the position P5 in a region extending from the position P1 to the position P2. In other words, the change in angle of an extending direction ED5 with respect to the extending direction ED1 at the position P1 is greatest in the rod-like flexible member 1850J. The angle FA of the extending direction ED5 with respect to the extending direction ED1 is greater than 90 degrees in this example. In this configuration, at least portions of the rod-like flexible member may overlap each other when the rod-like flexible member 1850J is viewed from above.

Seventh Embodiment

In the first embodiment, the neutral axis NA is disposed along the plane on which the key 100 pivots. In the seventh embodiment, the neutral axis NA may be disposed along a plane including the direction in which the keys 100 are arranged (i.e., the scale direction S) and the longitudinal direction of the key 100 (i.e., the front and rear direction F), in the state in which the key 100 is not pressed (that is, the key 100 is located at the rest position).

Figure 17:
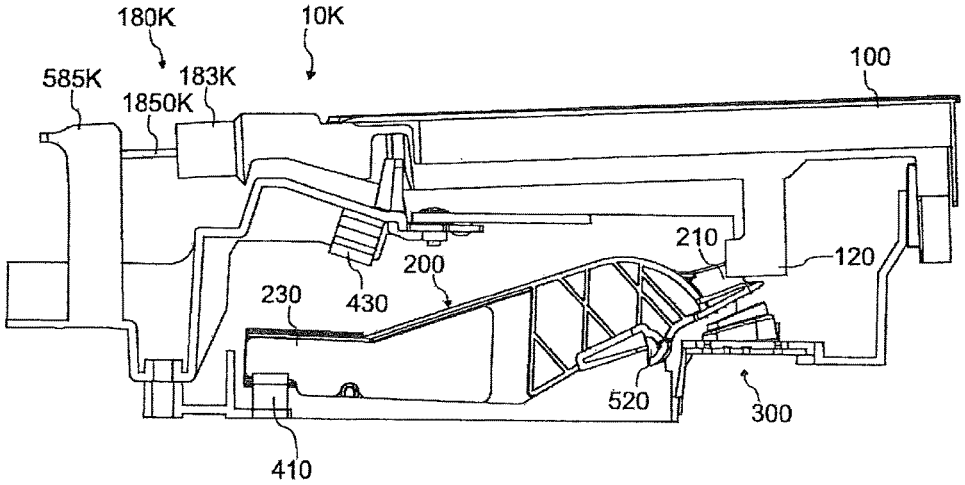
FIG. 17 is a view for explaining a configuration of a keyboard assembly in the case where a rod-like flexible member in a seventh embodiment is used.
Figure 18:
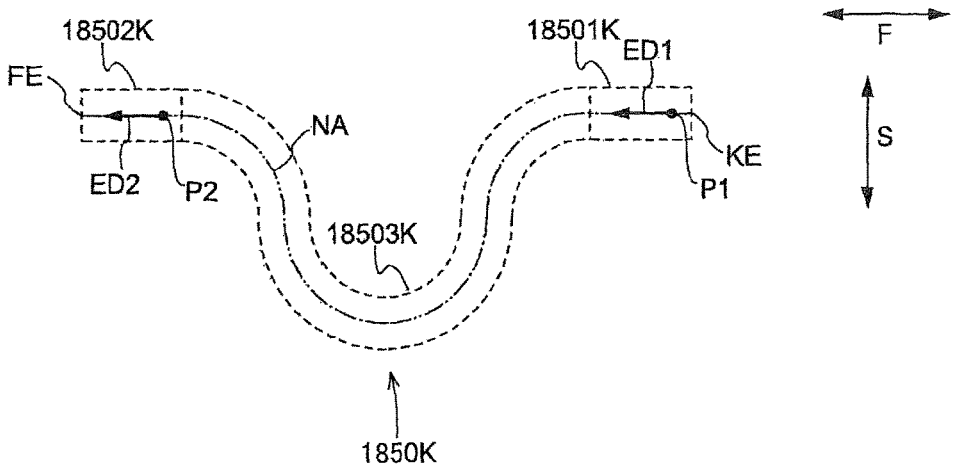
FIG. 18 is a view of a rod-like flexible member in the seventh embodiment, with the rod-like flexible member viewed from an upper side thereof.

FIG. 17 is a view for explaining a configuration of the keyboard assembly in the case where the rod-like flexible member in the seventh embodiment is used. FIG. 18 is a view of the rod-like flexible member in the seventh embodiment, with the rod-like flexible member viewed from an upper side thereof. A keyboard assembly 10K illustrated in FIG. 17 includes a connecting portion 180K including a first supporter 183K and a rod-like flexible member 1850K. The rod-like flexible member 1850K is supported by the first supporter 183K and a second supporter 585K. The second supporter 585K protrudes to a back side of a rear end of the key 100. As illustrated in FIG. 17, when viewed in the scale direction, the rod-like flexible member 1850K has a substantially straight-line shape extending in the longitudinal direction of the key 100.

As illustrated in FIG. 18, when viewed from above, the rod-like flexible member 1850K includes a first straight rod portion 18501K, a second straight rod portion 18502K, and a curved rod portion 18503K, for example. In this example, the curved rod portion 18503K has two inflection points and has the neutral axis NA included in a plane including the scale direction S and the front and rear direction F. It is noted that the rod-like flexible member 1850K configured as described above does not interfere with the rod-like flexible member 1850K corresponding to the adjacent key 100. It is noted that, as long as the rod-like flexible member 1850K does not interfere with the rod-like flexible member 1850K corresponding to the adjacent key 100, the frame-side end portion FE may be connected to the second supporter 585K located on a back side of the adjacent key 100.

Modifications

While the embodiments have been described above, it is to be understood that the disclosure is not limited to the details of the illustrated embodiments, but may be embodied with various changes and modifications, which may occur to those skilled in the art, without departing from the spirit and scope of the disclosure. The above-described embodiments may be combined or replaced with each other. Also, the following modifications may be made to each of the above-described embodiments.

(1) In the first embodiment, the neutral axis NA and the straight line SL are disposed along the plane on which the key 100 pivots. In the seventh embodiment, the neutral axis NA and the straight line SL are disposed along a plane including the direction in which the keys 100 are arranged (i.e., the scale direction) and the longitudinal direction of the key 100 in the state in which the key 100 is not pressed (that is, the key 100 is located at the rest position). The neutral axis NA of the rod-like flexible member may not satisfy these conditions. For example, the rod-like flexible member may be configured such that the straight line SL includes: a component along the plane on which the key 100 pivots (or a component in the pivotal direction); and a component of the scale direction in the state in which the key 100 is not pressed (that is, the key 100 is located at the rest position). For example, the rod-like flexible member may be shaped like a coil spring. In the above-described embodiments, the straight line SL has any of these components, by way of example.

(2) While the rod-like flexible member has various shapes in the above-described embodiments, the rod-like flexible members may not have the same shape for all the keys 100. For example, the rod-like flexible member connected to the white key 100*w* and the rod-like flexible member connected to the black key 100*b* may have different shapes. The rod-like flexible member connected to the high-pitch key 100 and the rod-like flexible member connected to the low-pitch key 100 may be different from each other in shape.

(3) The neutral axis NA at each of the key-side end portion KE and the frame-side end portion FE may not extend in the front and rear direction F or the up and down direction V and may be inclined with respect to each of the front and rear direction F and the up and down direction V.

(4) The pivot center of the black key 100*b* and the pivot center of the white key 100*w* may be located at the same position in the back direction. In this case, the sizes of the connecting portions 180*b*, 180*w* in the scale direction S need to be determined such that the connecting portions 180*b*, 180*w* can be disposed adjacent to each other.

(5) The connecting portion 180 includes the plate-like flexible member 181 and the rod-like flexible member 1850 in the above-described embodiments but may not include the plate-like flexible member 181.

(6) The key 100 is formed of resin, but a wood member may be stuck to a side surface of the key 100 at the visible portion PV (at the key main body portion) to enhance an appearance. In this case, the side-surface key guide 153 is preferably provided at a portion of the key 100 which is different from the portion of the key 100 to which the wood member is stuck, that is, the side-surface key guide 153 is preferably provided at a portion of the key 100 at which the resin portion is exposed. That is, the side-surface frame guide 513 contacts the resin portion of the key 100.

(7) The movement of the key 100 in the front and rear direction is restricted by the side-surface key guide 153 but may be restricted by another guide.

What is claimed is:

1. A keyboard apparatus, comprising:

a key;

a frame; and a connecting portion configured to connect the key and the frame to each other, the connecting portion comprising a flexible member having a rod shape and having flexibility that enables the key to pivot with respect to the frame, wherein the flexible member comprises a portion that, in entirety of a range of pivotal movement of the key, maintains a state in which a length of a line extending along a neutral axis of the flexible member between two points located on the neutral axis is greater than a length of a straight line connecting the two points to each other.

2. The keyboard apparatus according to claim 1, wherein the neutral axis is an axis extending along a direction in which the flexible member extends.

3. The keyboard apparatus according to claim 1, wherein the straight line connecting the two points located on the neutral axis comprises a component in a direction along a plane on which the key pivots.

4. The keyboard apparatus according to claim 1, further comprising a plurality of keys each as the key, wherein the straight line connecting the two points located on the neutral axis comprises a component in a direction in which the plurality of keys are arranged.

5. The keyboard apparatus according to claim 1, wherein at least a portion of the flexible member comprises:

a first straight rod portion extending in a longitudinal direction of the key;

a second straight rod portion extending in an up and down direction; and an intermediate rod portion having a rod shape, connecting the first straight rod portion and the second straight rod portion to each other, and extending in a direction different from each of the longitudinal direction and the up and down direction.

6. The keyboard apparatus according to claim 5, wherein one of the first straight rod portion and the second straight rod portion is disposed nearer to the key than another of the first straight rod portion and the second straight rod portion, and wherein said another of the first straight rod portion and the second straight rod portion is disposed nearer to the frame than the one of the first straight rod portion and the second straight rod portion.

7. The keyboard apparatus according to claim 1, wherein, in at least a portion of the range of the pivotal movement of the key, an angle between a longitudinal direction of the key and a direction in which the flexible member extends at a first position is less than 45 degrees, and an angle between the longitudinal direction of the key and a direction in which the flexible member extends at a second position is greater than 45 degrees.

8. The keyboard apparatus according to claim 1, wherein, in at least a portion of the range of the pivotal movement of the key, an extending direction in which the flexible member extends changes by greater than or equal to 90 degrees in a change in the extending direction from a third position to a fourth position on the flexible member.

9. The keyboard apparatus according to claim 1, wherein the neutral axis comprises a corner portion.

10. The keyboard apparatus according to claim 1, wherein the neutral axis comprises a curve.

11. The keyboard apparatus according to claim 1, wherein an area of the flexible member in cross section perpendicular to the neutral axis is deferent between the two points.

12. The keyboard apparatus according to claim 1, further comprising a guide configured to restrict movement of the key with respect to the frame in a longitudinal direction of the key.

13. A keyboard apparatus, comprising:

a key;

a frame; and a connecting portion configured to connect the key and the frame to each other, the connecting portion comprising a flexible member having a rod shape and having flexibility that enables the key to pivot with respect to the frame, wherein the flexible member comprises a portion that, in entirety of a range of pivotal movement of the key, maintains a state in which a neutral axis of the flexible member is bent.

14. A keyboard apparatus, comprising:

a key;

a frame; and a connecting portion configured to connect the key and the frame to each other, the connecting portion comprising a flexible member having a rod shape and having flexibility that enables the key to pivot with respect to the frame, wherein at least a portion of the flexible member comprises:

a first straight rod portion extending in a longitudinal direction of the key;

a second straight rod portion extending in an up and down direction; and an intermediate rod portion having a rod shape, connecting the first straight rod portion and the second straight rod portion to each other, and extending in a direction different from each of the longitudinal direction and the up and down direction.

* * * * *